US008038462B2

(12) United States Patent
Svelnis et al.

(10) Patent No.: US 8,038,462 B2
(45) Date of Patent: Oct. 18, 2011

(54) WATER-TIGHT ELECTRICAL CONNECTOR WITH LATERALLY COMPRESSED O-RING

(75) Inventors: Christine M. Svelnis, Boylston, MA (US); Craig H. Baker, Shrewsbury, MA (US); Jeffrey S. Burkhardt, Brookline, NH (US)

(73) Assignee: Anderson Power Products, Inc., Sterling, MA (US)

( * ) Notice: Subject to any disclaimer, the term of this patent is extended or adjusted under 35 U.S.C. 154(b) by 0 days.

(21) Appl. No.: 13/014,373

(22) Filed: Jan. 26, 2011

(65) Prior Publication Data

US 2011/0189877 A1 Aug. 4, 2011

Related U.S. Application Data

(60) Provisional application No. 61/301,364, filed on Feb. 4, 2010.

(51) Int. Cl.
*H01R 4/50* (2006.01)

(52) U.S. Cl. ..... 439/347

(58) Field of Classification Search ..... 439/347, 439/271

See application file for complete search history.

(56) References Cited

U.S. PATENT DOCUMENTS

| | | | | |
|---|---|---|---|---|
| D311,733 | S | 10/1990 | Kuzuno et al. | |
| 5,127,848 | A | 7/1992 | Taguchi | |
| 5,651,689 | A | 7/1997 | Plyler et al. | |
| D415,999 | S | 11/1999 | Esposito | |
| 6,171,136 | B1 | 1/2001 | Liu et al. | |
| D503,150 | S | 3/2005 | Yamawaki et al. | |
| 6,942,514 | B1 * | 9/2005 | Cheng et al. | 439/328 |
| D522,459 | S | 6/2006 | Chen et al. | |
| D544,843 | S | 6/2007 | Sugita et al. | |
| D599,297 | S | 9/2009 | Chen | |
| 2009/0035976 | A1 | 2/2009 | Matsunaga | |
| 2010/0228405 | A1 * | 9/2010 | Morgal et al. | 701/2 |

FOREIGN PATENT DOCUMENTS

| | | | |
|---|---|---|---|
| DE | 3709461 | A1 | 10/1987 |
| GB | 2020917 | A | 11/1979 |
| JP | 2004281370 | A | 10/2004 |

OTHER PUBLICATIONS

European Patent Office Search Report for Application No. 11152958.2, May 19, 2011, 8pages.

* cited by examiner

*Primary Examiner* — Phuong Dinh
(74) *Attorney, Agent, or Firm* — Vern Maine & Associates

(57) ABSTRACT

An electrical connector housing system provides a water-tight o-ring seal between a receptacle housing and a plug housing without compressing the o-ring in the mating direction. The housing system includes at least two latch sliders that can be engaged to trap latch tabs within latch slots. The latch sliders are substantially unaffected by the o-ring compression, and are compatible with housing systems of almost any size and/or shape. Embodiments include a connector region surrounded by a curved wall having an o-ring groove in its outer surface, and the plug housing includes a shell which overlaps the curved wall and compresses the o-ring perpendicular to the mating direction. The housings can include integral electrical contacts and/or can accept one or more insertable contacts. The latch sliders. The latch mechanism can include a detent mechanism, and can require a tool for disengagement.

18 Claims, 28 Drawing Sheets

ISOMETRIC

ISOMETRIC

REVERSE ISOMETRIC

TOP VIEW

RIGHT VIEW

LEFT VIEW

BACK VIEW

ISOMETRIC

REVERSE ISOMETRIC

RIGHT VIEW

LEFT VIEW

BACK VIEW

BOTTOM VIEW

ISOMETRIC

REVERSE ISOMETRIC

WATER-TIGHT ELECTRICAL CONNECTOR WITH LATERALLY COMPRESSED O-RING

RELATED APPLICATIONS

This application claims the benefit of U.S. Provisional Applications No. 61/301,364, filed Feb. 4, 2010, which is herein incorporated by reference in its entirety for all purposes.

FIELD OF THE INVENTION

The invention relates to electrical connectors, and more particularly to electrical connectors that are sealed against penetration by water.

BACKGROUND OF THE INVENTION

Single and multiple contact electrical connector systems are widely used for many household and industrial applications. Typically, such connector systems include a plug and a compatible receptacle, each of which includes or can accept installation of one or more electrical contacts that are connected to each other when the plug is mated with the receptacle. Plug and receptacle housings are provided so as to isolate the electrical contacts, position them in alignment with each other, and maintain the contacts in secure connection with each other when the connectors are mated. The contacts may be integral with the housings, or they may be installable into the housings, so that a given housing system can accept a plurality of types and arrangements of contacts. Often, a latch mechanism is included with the housings so as to avoid inadvertent separation of the plug from the receptacle.

Electrical connectors are subject to various standards and requirements, depending on their intended usages. In particular, if a connector is to be used in a location where it will be exposed to the weather, then it typically must include a sealing mechanism that will prevent water and other debris from reaching the electrical contacts. One approach to sealing a connector housing system against water penetration is to include a gasket or o-ring that is compressed between the plug housing and the receptacle housing when the plug and receptacle are mated. However, this approach requires that a sealing force be applied to the gasket or o-ring which is of sufficient magnitude to provide a water-tight seal. The required sealing force is approximately proportional to the circumference of the gasket or o-ring to be compressed, which corresponds roughly to the size of the connector housing system, so that large connector housing systems employing this approach typically require latch mechanisms that can apply a significant amount of compressive force to the housings, the required force being well beyond what would be required just to securely hold the plug and receptacle together.

Latch mechanisms such as clamps and nuts tightened onto bolts are well known in the art. However, they are typically cumbersome, and require significant time and effort to engage and release. Some latch mechanisms include a threaded collar or a twist-lock collar, but these latch mechanisms are mainly suitable for connector housings which are substantially circular in cross section.

Still other latch mechanisms include a spring-like clipping mechanism, but these latch mechanisms are suitable mainly for small, lightweight connector housings.

What is needed, therefore, is an electrical power connector housing system that can provide a water-tight seal without application of compressive force, the connector housing system including a latch mechanism which is suitable for both small and large housings and which does not require the connector housing to be substantially circular in cross section, thereby enabling implementation of the connector housing over a large range of sizes and shapes.

SUMMARY OF THE INVENTION

A versatile electrical connector housing system with a latch mechanism is claimed that provides a water-tight seal without application of compressive force. The latch mechanism is suitable for both small and large housings, and does not require the connector housing to be substantially circular in cross section, thereby enabling implementation of the connector housing over a large range of sizes and shapes.

The claimed connector housing system includes a plug housing, a compatible receptacle housing, and a latch mechanism. The receptacle housing includes a curved wall surrounding an electrical contact region, the curved wall having an o-ring groove formed in an outer surface thereof and lying in a plane perpendicular to the mating direction of the housings. The plug housing includes an overlapping shell configured to surround and overlap the curved wall when the plug housing is mated with the receptacle housing, thereby laterally compressing an o-ring located in the o-ring groove. The o-ring is thereby compressed in a direction perpendicular to the mating direction of the plug and connector. There is no compressive force applied or required along the mating direction of the connector housings.

The latch mechanism includes a pair of latch sliders installed on opposing sides of the receptacle housing which can be engaged behind a pair of corresponding latch tabs extending outward from opposing sides of the overlapping shell of the plug housing, thereby trapping the plug housing in mated relationship with the receptacle housing. In certain embodiments, a detent mechanism maintains the latch mechanism in its latched configuration. In some embodiments the latch mechanism can be disengaged without use of a tool or other implement, while in other embodiments use of a tool or other implement is required so as to disengage the latch mechanism.

Due to the lateral compression of the o-ring, the action of the latch mechanism is substantially unaffected by the o-ring seal, and need only serve to inhibit inadvertent separation of the plug from the receptacle. And because the latch mechanism is implemented only at discrete locations on the perimeter of the connector housing, substantially no restrictions are imposed on the shape of the connector housing system.

In various embodiments, the plug and receptacle housings include integrated electrical contacts, and/or the plug and receptacle housings are configured to accept installation of one or more insertable electrical contacts. In some of these embodiments, any of a plurality of insertable electrical contacts can be installed in the housings, in any of a plurality of configurations.

One general aspect of the present invention is a water-tight connector housing system which includes a receptacle housing configured for housing at least one receptacle electrical contact, a plug housing configured for housing at least one plug electrical contact, the plug housing being configured for mating with the receptacle housing in a mating direction so as to create an electrical connection between the receptacle electrical contact and the plug electrical contact, and a latch mechanism which can be transitioned between an unlatched configuration and a latched configuration, the latch mechanism in the latched configuration being able to inhibit separation of the plug housing from the receptacle housing when the plug housing is mated to the receptacle housing, the latch mechanism including a plurality of latch tabs extending outward from the overlapping shell of the plug housing, a plurality of latch slots formed in the outer shell of the receptacle housing and configured to accept insertion therein of the latch tabs when the plug housing is mated with the receptacle housing, and a plurality of latch sliders mounted in the receptacle housing and slidable between latched positions and unlatched positions, the latch sliders being configured so as to pass behind the latch tabs and thereby trap the latch tabs within the latch slots when the plug housing is mated with the receptacle housing and the latch sliders are moved to the latched positions.

The connector housing system also includes a receptacle contact support structure contained within the receptacle housing and configured for supporting the at least one receptacle electrical contact, the receptacle contact support structure being substantially planar and oriented perpendicular to the mating direction, the receptacle contact support structure being supported by a curved wall surrounding a perimeter of the receptacle contact support structure and extending rearward from the receptacle contact support structure. An o-ring groove is formed in an outward-facing surface of the curved wall, the o-ring groove lying in a plane that is perpendicular to the mating direction.

The connector housing system further includes a plug contact support structure contained within the plug housing and configured for supporting the at least one plug electrical contact, the plug contact support structure being substantially planar and oriented perpendicular to the mating direction, and an overlapping shell surrounding a perimeter of the plug contact support structure and extending forward from the plug contact support structure in the mating direction, the overlapping shell being configured so as to overlap and surround the curved wall and compress an o-ring located in the o-ring groove when the plug housing is mated with the receptacle housing, the o-ring being thereby compressed in a direction perpendicular to the mating direction so as to apply substantially no reactive force to the latch mechanism in the latched configuration.

In certain embodiments, the water-tight connector housing system further includes a detent mechanism configured so as to inhibit transitioning of the latch mechanism from the latched configuration to the unlatched configuration.

In some embodiments the latch mechanism can be manually transitioned from the latched configuration to the unlatched configuration without use of a tool. In other embodiments, use of a tool is required so as to transition the latch mechanism from the latched configuration to the unlatched configuration.

In various embodiments, each of the receptacle contact support structure and the plug contact support structure includes at least one permanently mounted electrical contact. And in certain embodiments each of the receptacle contact support structure and the plug contact support structure is configured to accept at least one insertable electrical contact.

In some embodiments the receptacle housing further includes an outer shell configured to surround and guide the overlapping shell of the plug housing when the plug housing is mated with the receptacle housing. In some of these embodiments the plug housing further includes an orientation key tab extending outward from the overlapping shell, and the receptacle housing includes an orientation key slot extending outward from the outer shell, the orientation key slot being cooperative with the orientation key tab so as to inhibit mating of the plug housing with the receptacle housing if the plug housing is not correctly oriented relative to the receptacle housing.

In various embodiments which include a detent mechanism configured so as to inhibit transitioning of the latch mechanism to the unlatched configuration when the latch mechanism is in the latched configuration, the detent mechanism includes a detent hole in each of the pair of latch sliders and a pair of detent sliders pressed by a pair of springs against the pair of latch sliders, the springs being configured so as to seat ends of the detent sliders in the detent holes when the latch sliders are in the latched positions.

In certain embodiments at least one of the receptacle housing and the plug housing is configured for direct attachment to an electrical cable. In some embodiments at least one of the receptacle housing and the plug housing is configured for mounting to a flat surface. And in other embodiments at least one of the receptacle housing and the plug housing is configured for mounting to a threaded conduit.

Various embodiments further include a plurality of insertable receptacle electrical contacts configured for installation in the receptacle contact support structure and an equal number of insertable plug electrical contacts configured for installation in the plug contact support structure, the receptacle electrical contacts being configured for interlocking interconnection when installed in the receptacle contact support structure, and the plug electrical contacts being configured for interlocking inter-connection when installed in the plug contact support structure.

Another general aspect of the present invention is a water-tight connector housing system which includes a receptacle housing configured for housing at least one receptacle electrical contact, a plug housing configured for housing at least one plug electrical contact, the plug housing being configured for mating with the receptacle housing in a mating direction so as to create an electrical connection between the receptacle electrical contact and the plug electrical contact, an o-ring groove configured within the receptacle housing so as to cause an o-ring located in the o-ring groove to be compressed in a direction perpendicular to the mating direction when the plug housing is mated with the receptacle housing, so that substantially no compressive force is required to maintain the plug housing in mated relationship with the receptacle housing, and a latch mechanism which can be transitioned between an unlatched configuration and a latched configuration, the latch mechanism including a plurality of latch sliders cooperative with one of the plug housing and the receptacle housing and a corresponding plurality of latch tabs cooperative with the other of the plug housing and the receptacle housing, the latch sliders being able to trap the latch tabs when the latch mechanism is in the latched configuration so as to inhibit separation of the plug housing from the receptacle housing when the plug housing is mated to the receptacle housing, said compression of the o-ring applying substantially no reactive force to the latch mechanism in the latched configuration.

In some embodiments the latch mechanism can be manually transitioned from the latched configuration to the unlatched configuration without use of a tool. In other embodiments use of a tool is required so as to transition the latch mechanism from the latched configuration to the unlatched configuration.

In various embodiments each of the receptacle housing and the plug housing includes at least one permanently mounted electrical contact. And in certain embodiments each of the receptacle housing and the plug housing is configured to accept at least one insertable electrical contact.

The features and advantages described herein are not all-inclusive and, in particular, many additional features and advantages will be apparent to one of ordinary skill in the art in view of the drawings, specification, and claims. Moreover, it should be noted that the language used in the specification has been principally selected for readability and instructional purposes, and not to limit the scope of the inventive subject matter.

DETAILED DESCRIPTION

The present invention is a versatile electrical connector housing system with a latch mechanism that provides a watertight seal without application of compressive force. The latch mechanism is suitable for both small and large housings, and does not require the connector housing to be substantially circular in cross section, thereby enabling implementation of the connector housing over a large range of sizes and shapes.

The claimed connector housing system includes a plug housing, a compatible receptacle housing, and a latch mechanism. The receptacle housing includes a curved wall in which an o-ring groove is formed, the o-ring groove lying in a plane that is perpendicular to the mating direction. The compatible plug-housing includes an overlapping shell configured to surround and overlap the curved wall when the plug and receptacle housings are mated, thereby compressing an o-ring positioned in the o-ring groove between the curved wall and the overlapping shell. The compressive force is thereby applied in a direction perpendicular to the mating direction of the plug and receptacle housings, and does not tend to resist mating of the connectors.

The latch mechanism includes a pair of latch sliders installed on opposing sides of the receptacle housing. The latch sliders can be engaged behind a pair of corresponding latch tabs extending outward from opposing sides of the overlapping shell of the plug housing, thereby trapping the plug housing in mated relationship with the receptacle housing. In certain embodiments a detent mechanism maintains the latch mechanism in its latched configuration. In some embodiments the latch mechanism can be disengaged without use of a tool or other implement, while in other embodiments use of a tool or other implement is required so as to disengage the latch mechanism.

Due to the lateral compression of the o-ring, the action of the latch mechanism is substantially independent of the o-ring compression, and need only operate so as to inhibit inadvertent separation of the plug housing from the receptacle housing. And because the latch mechanism is implemented only at discrete locations on the perimeter of the connector housing, substantially no restrictions are imposed on the shape of the connector housing system.

Figure 1A:
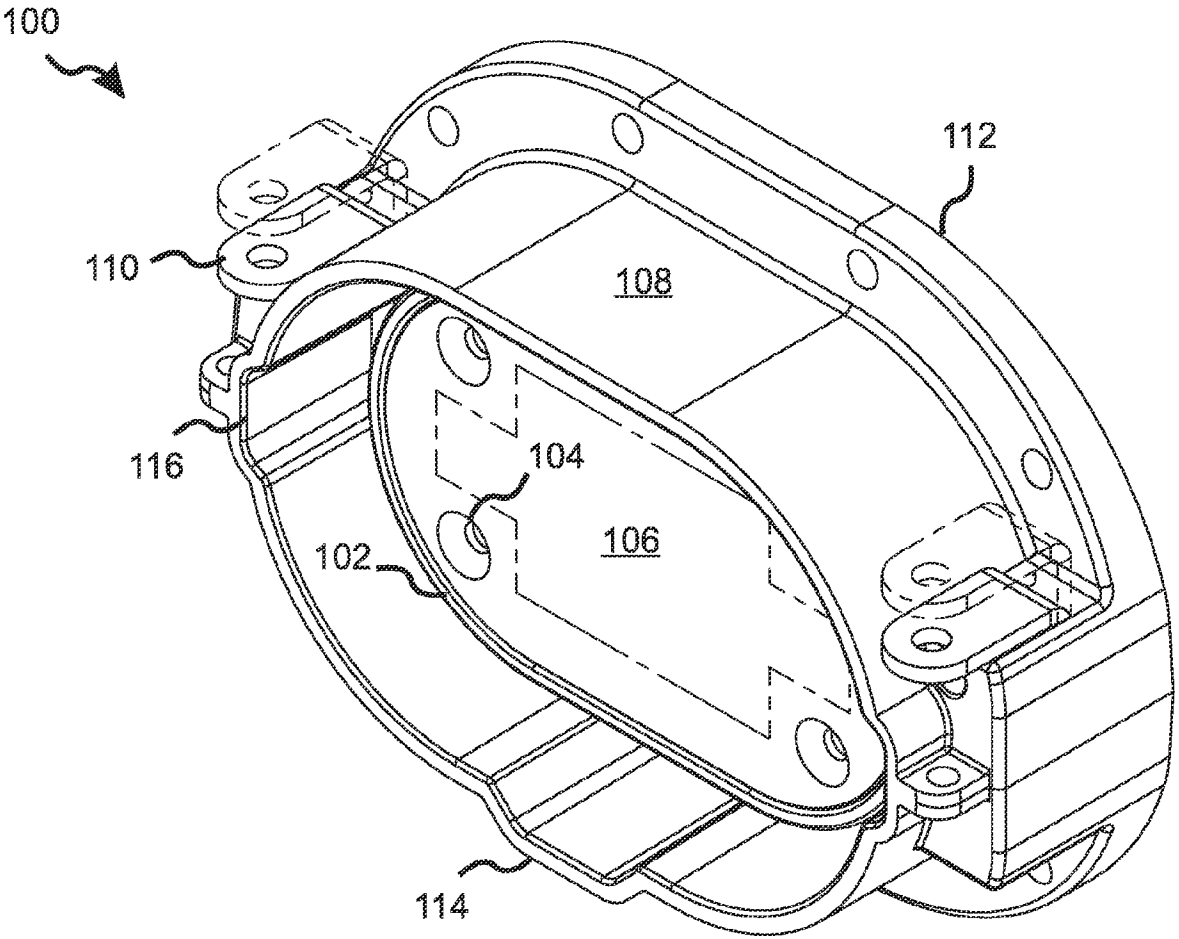
FIG. 1A is a perspective view of a receptacle housing of a preferred embodiment, the receptacle housing being configured for mounting on a panel or other flat surface.

FIG. 1A is a perspective illustration of the receptacle housing 100 of an embodiment of the present invention. The receptacle housing 100 includes a curved wall 102 surrounding an installable electrical contact region that contains a contact installation region 106 where any of a plurality of insertable electrical contacts of various types can be installed in any of a plurality of configurations. In the embodiment of FIG. 1A, the contact installation region 106 is a separate unit which is held in place within the receptacle housing 100 by mounting screws inserted through screw holes 104 in the contact installation region 106. The curved wall 102 is surrounded by an outer receptacle shell 108 that provides additional protection to the contact region and serves to guide the plug housing (200 in FIG. 2A) into alignment with the receptacle housing 100.

Figure 1B:
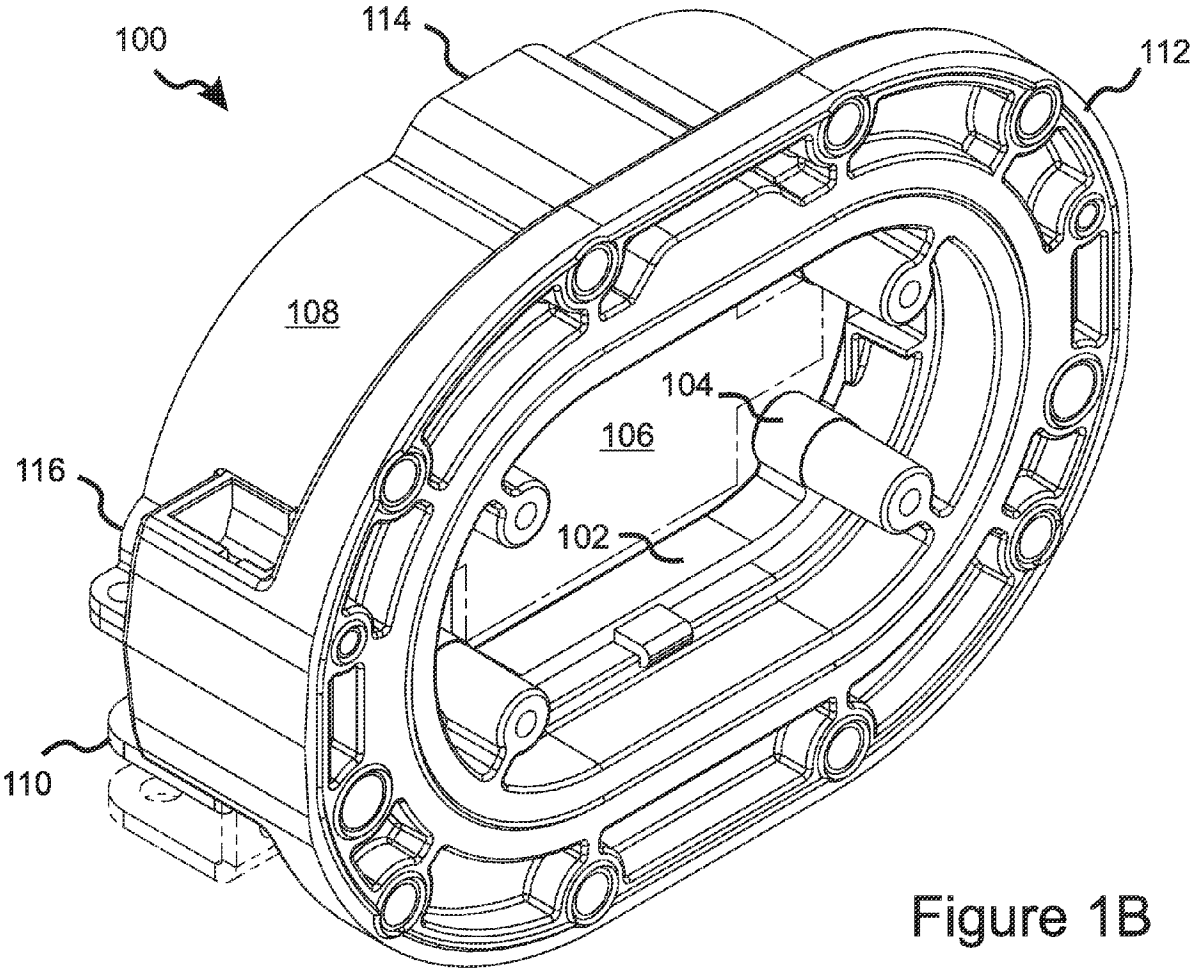
FIG. 1B is a reverse perspective view of the receptacle housing of FIG. 1A.

A pair of latch sliders (118 in FIG. 1C) is installed in the receptacle housing 100, the latch sliders 118 terminating in slider tabs 110 that can be manually pressed to engage the latch mechanism and lifted so as to disengage the latch mechanism. In FIG. 1A the slider tabs 110 are shown in solid lines in their latched positions, and in dashed lines in their unlatched positions. A panel flange 112 provides for mounting of the receptacle housing 100 to a panel or other flat surface. In similar embodiments, the receptacle housing 100 is configured for mounting directly to a cable or to a conduit such as a threaded hose or pipe. An orientation key slot 114 is provided in the outer shell 108 so as to prevent inverted mating of the plug housing 200 with the receptacle housing 100. A pair of latch indentations 116 is provided on opposing sides of the outer shell 108 so as to accommodate the latch tabs (216 in FIG. 2A) included on opposing sides of the plug housing (200 in FIG. 2A). FIG. 1B is a reverse perspective view of the receptacle housing 100 of FIG. 1A.

Figure 1C:
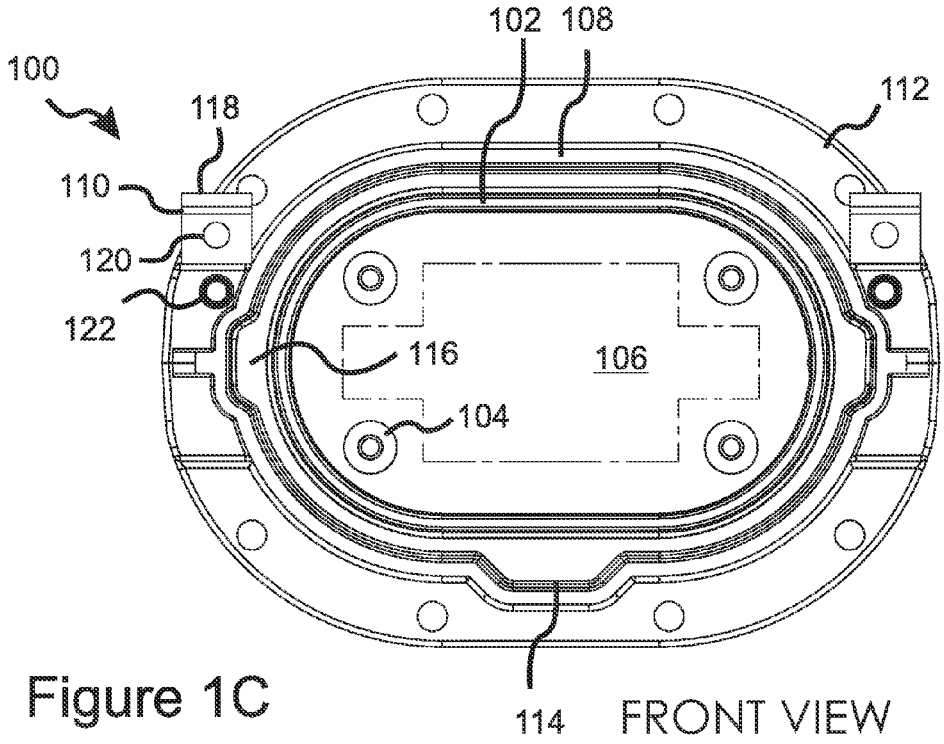
FIG. 1C is a front view of the receptacle housing of FIG. 1A, shown with the latch sliders in their unlatched positions.

FIG. 1C is a front view of the receptacle housing 100 of FIG. 1A, shown with the latch sliders 118 in their unlatched positions. In this view it can be seen that the latch sliders 118 include holes 120. The holes are cooperative with detents 122 comprising springs and detent sliders that nest within the holes 120 so as to maintain the latch sliders 118 in their latched positions.

Figure 1D:
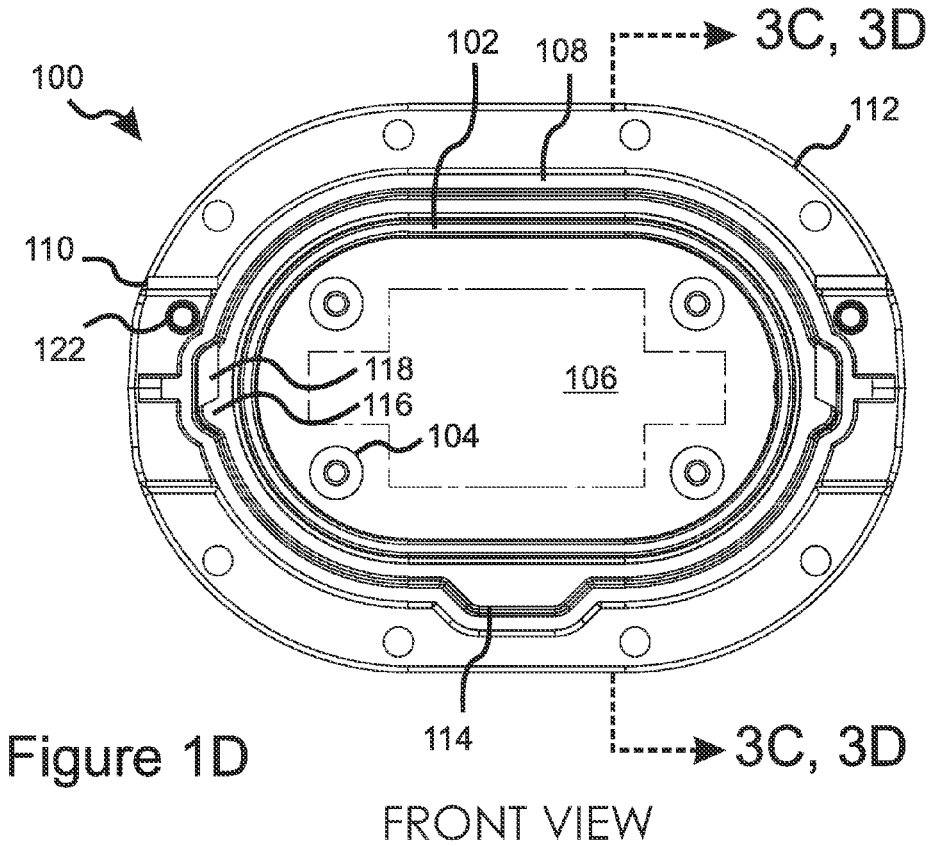
FIG. 1D is a front view of the receptacle housing of FIG. 1A, shown with the latch sliders in their latched positions.
Figure 1E:
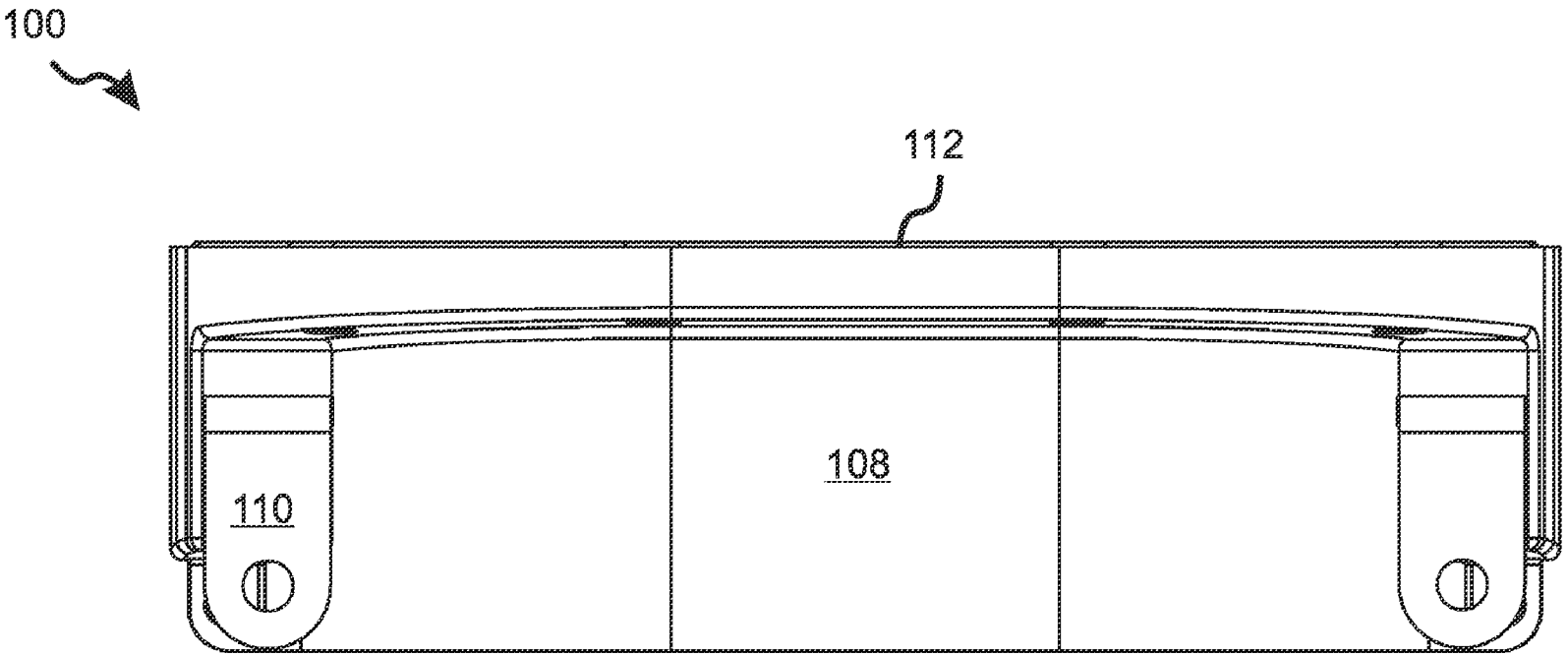
FIGS. 1E through 1I are top, right, left, back, and bottom views respectively of the receptacle housing of FIG. 1A.
Figure 1F:
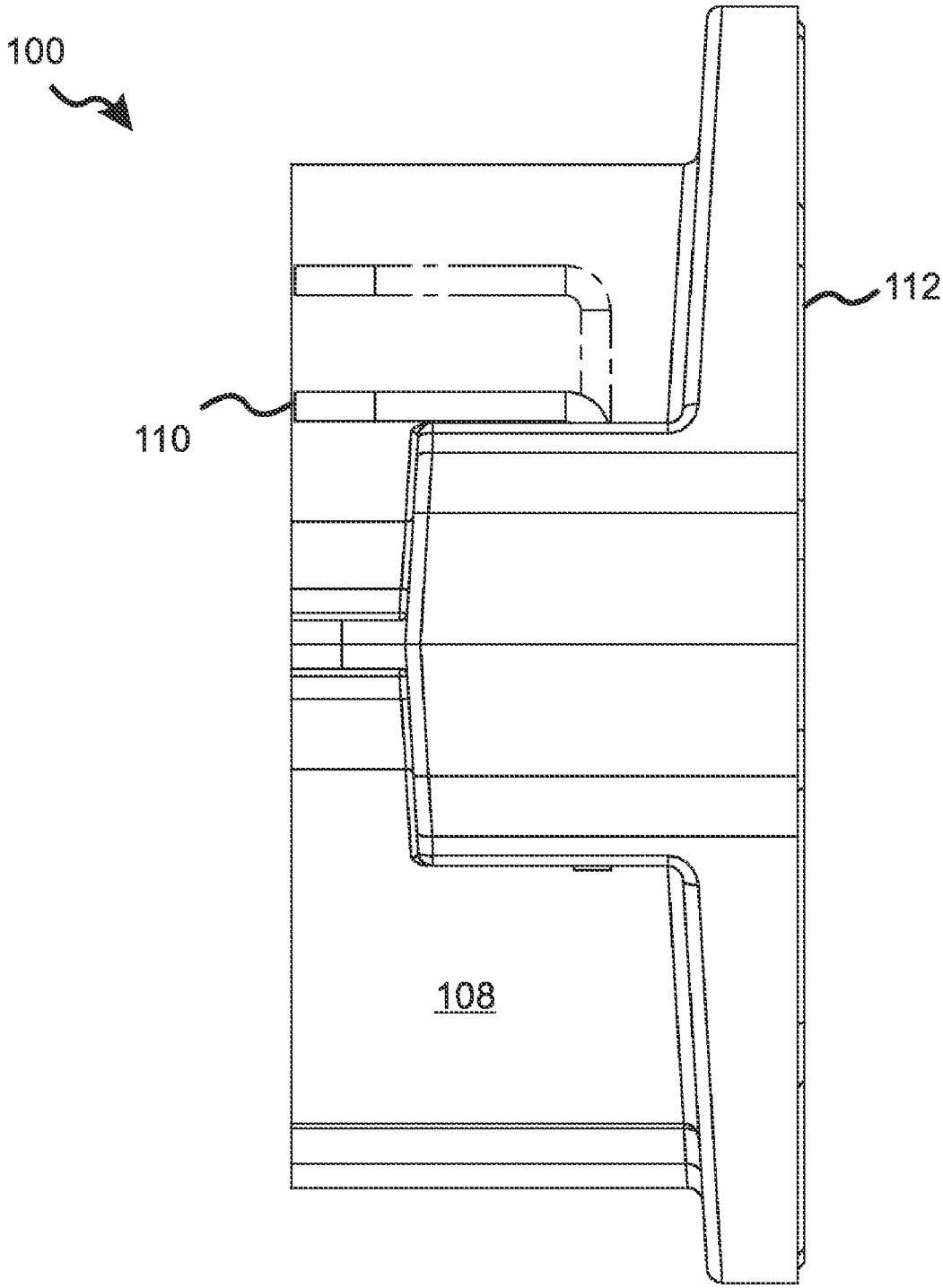
Figure 1G:
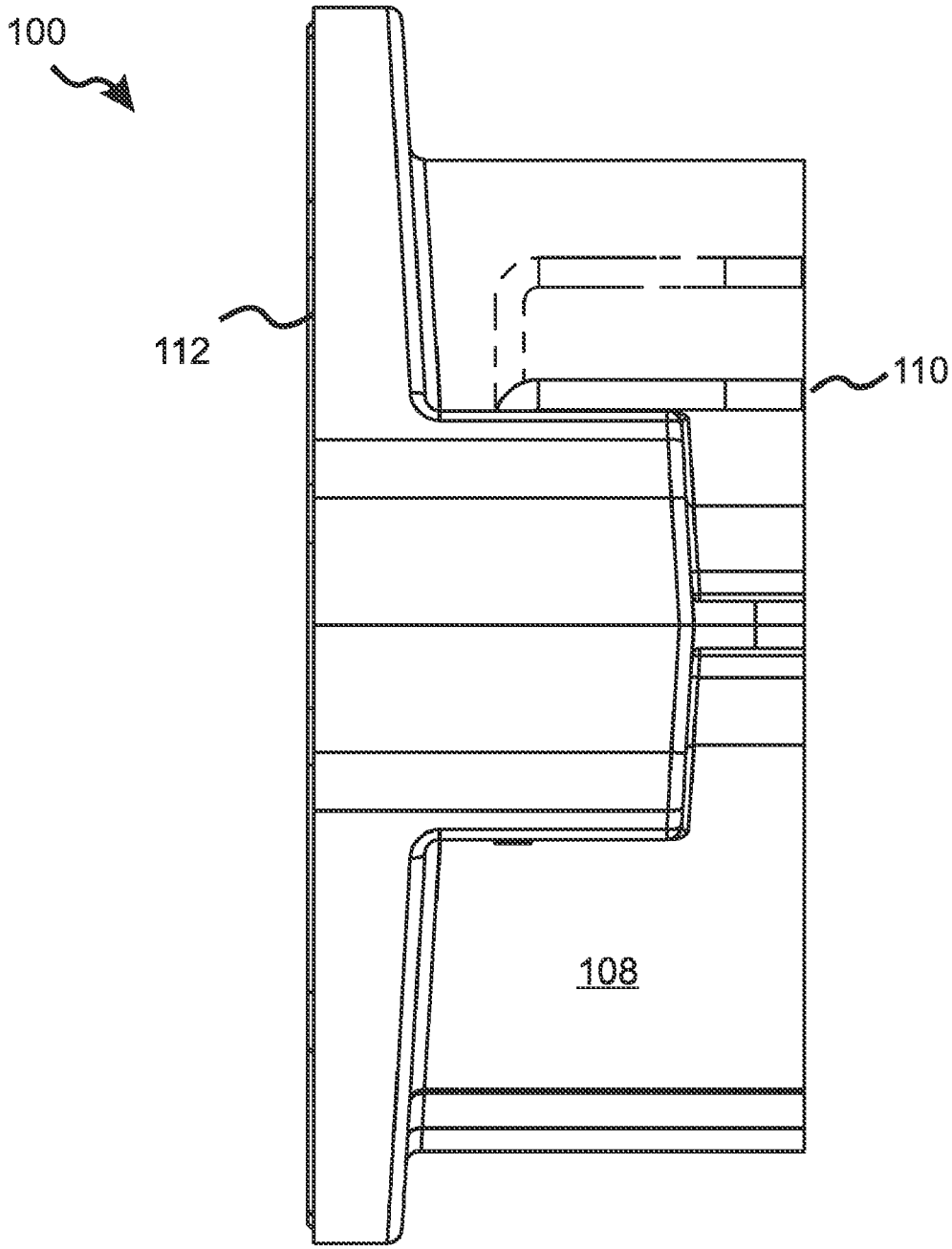
Figure 1H:
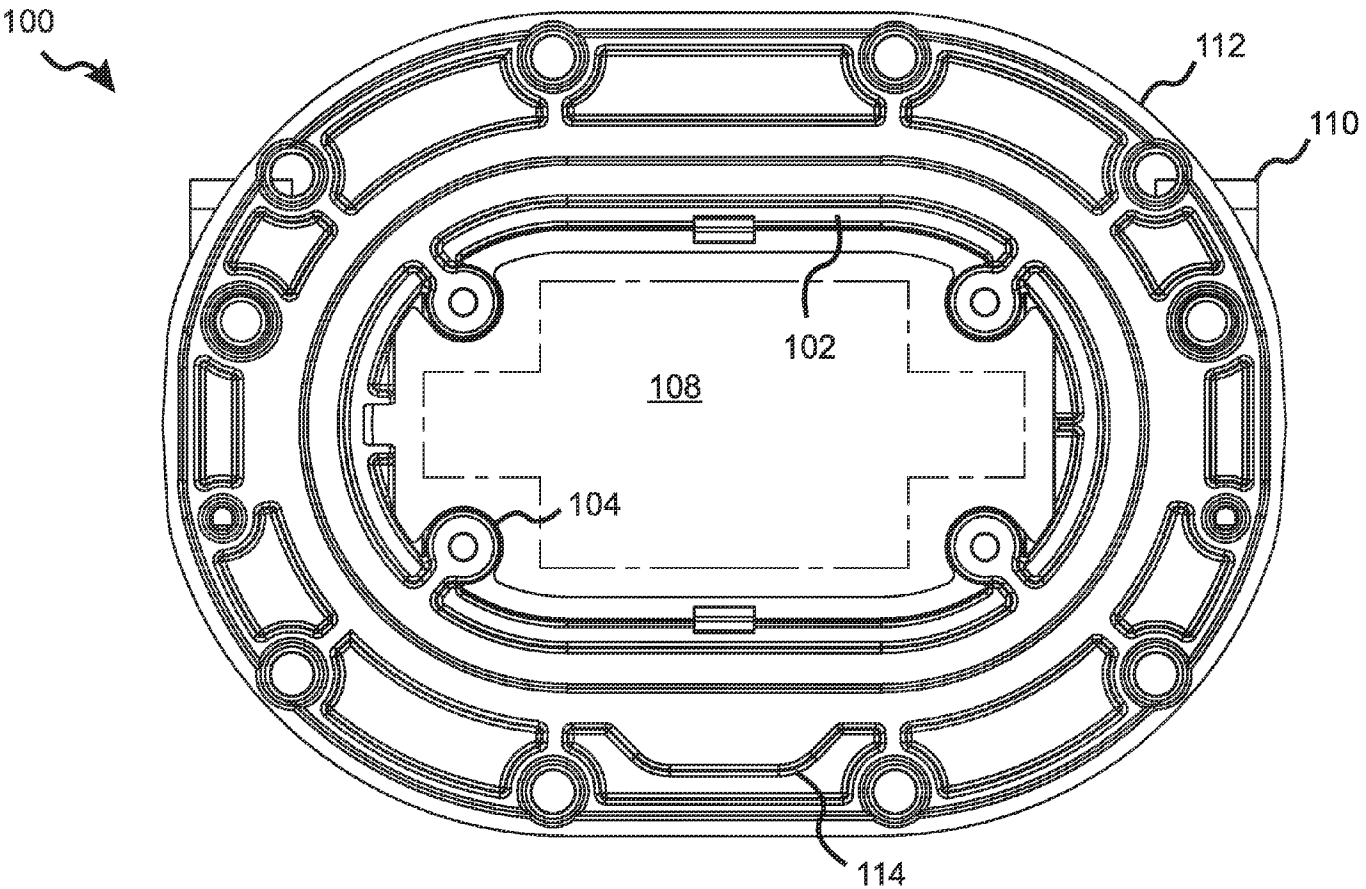
Figure 1I:
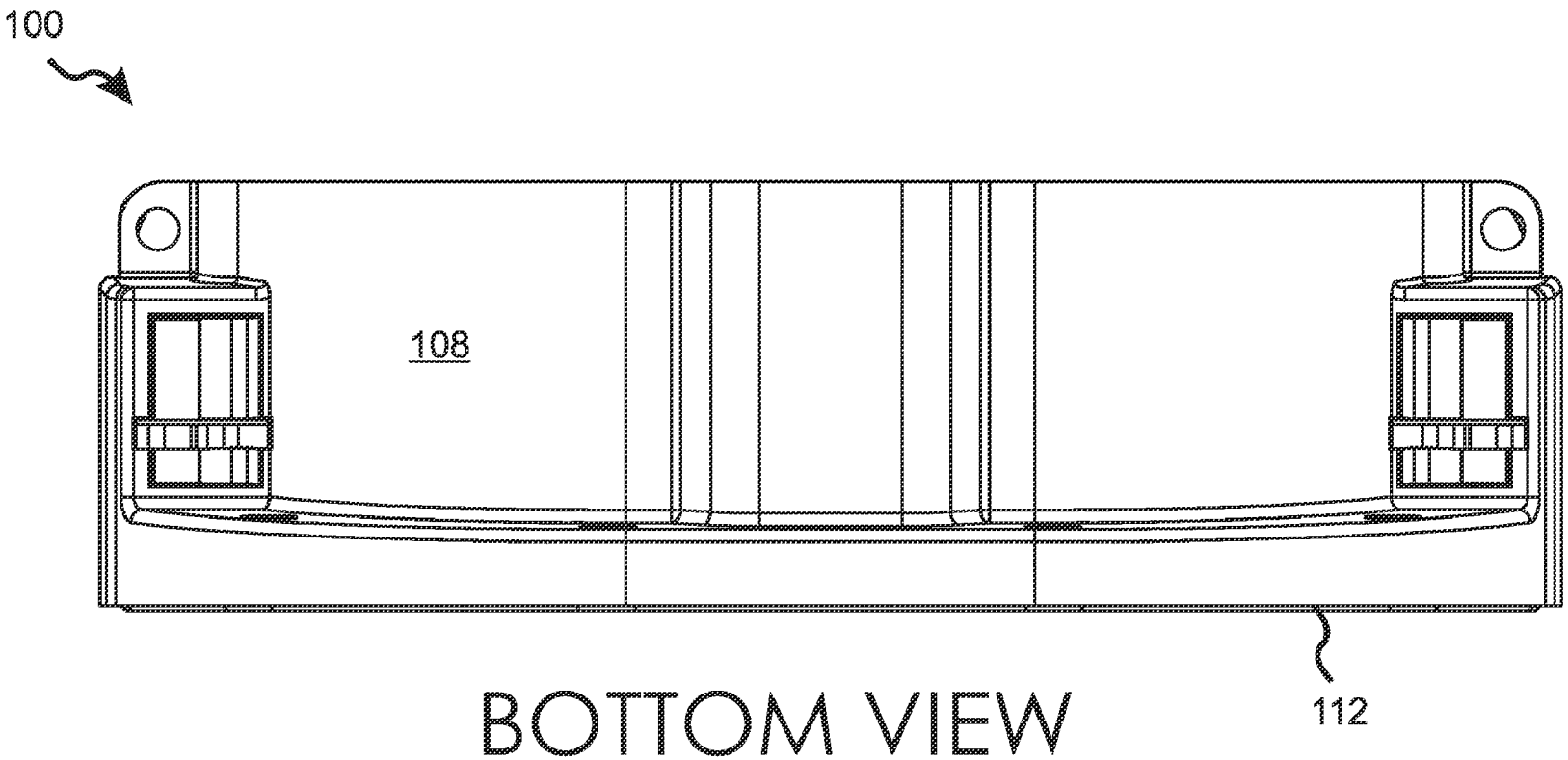

FIG. 1D is a front view of the receptacle housing 100 of FIG. 1A, shown with the latch sliders 118 in their latched positions. In this view, the latch sliders 118 can be seen overlapping the latch indentations 116, so as to close off the latch indentations 116 and trap the latch tabs 216 behind the latch sliders 118, thereby holding the plug housing 200 in mated relationship with the receptacle housing 100. A location is indicted in FIG. 1D that corresponds to cross-sectional illustrations included in FIGS. 3C and 3D, discussed below. FIGS. 1E through 1I are top, right, left, back, and bottom views respectively of the receptacle housing of FIG. 1A.

Figure 2A:
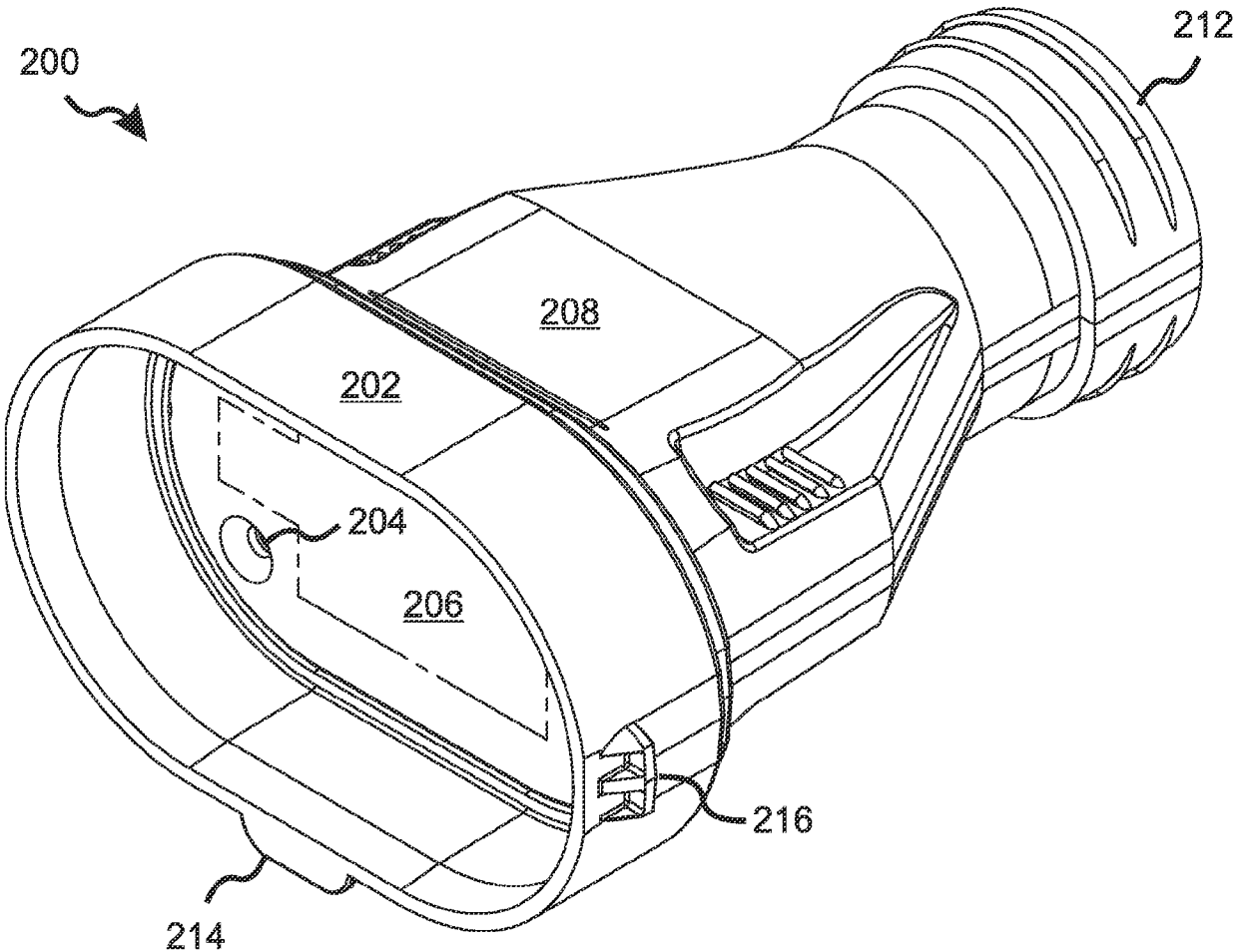
FIG. 2A is a perspective view of a plug housing of a preferred embodiment, the plug housing being configured for direct attachment to a threaded conduit.

FIG. 2A is a perspective view of the plug housing 200 of the embodiment of FIG. 1A. The plug housing 200 includes an overlapping shell 202 that is configured to fit within the outer receptacle shell 108 of the receptacle housing 100 and to surround and overlap the curved wall 102 of the receptacle housing 100 when the plug housing 200 is mated with the receptacle housing 100. The overlapping shell 202 surrounds an installable electrical contact region that contains an installable contact area 206 where any of a plurality of insertable contacts of various types can be installed in any of a plurality of configurations. In similar embodiments the installable contact area 206 is/are provided in different configurations. And in some embodiments permanently integrated contacts are included and/or the installable contact area 206 is omitted altogether.

In the embodiment of FIG. 2A the installable contact area is held in place within the plug housing by screws inserted through screw holes 204 in the installable contact area 206. When the plug housing 200 is mated with the receptacle housing 100, the electrical contact area of the plug housing 200 is aligned with the electrical contact area of the receptacle housing 100, thereby providing for electrical connection of the electrical contacts contained therein.

Figure 2B:
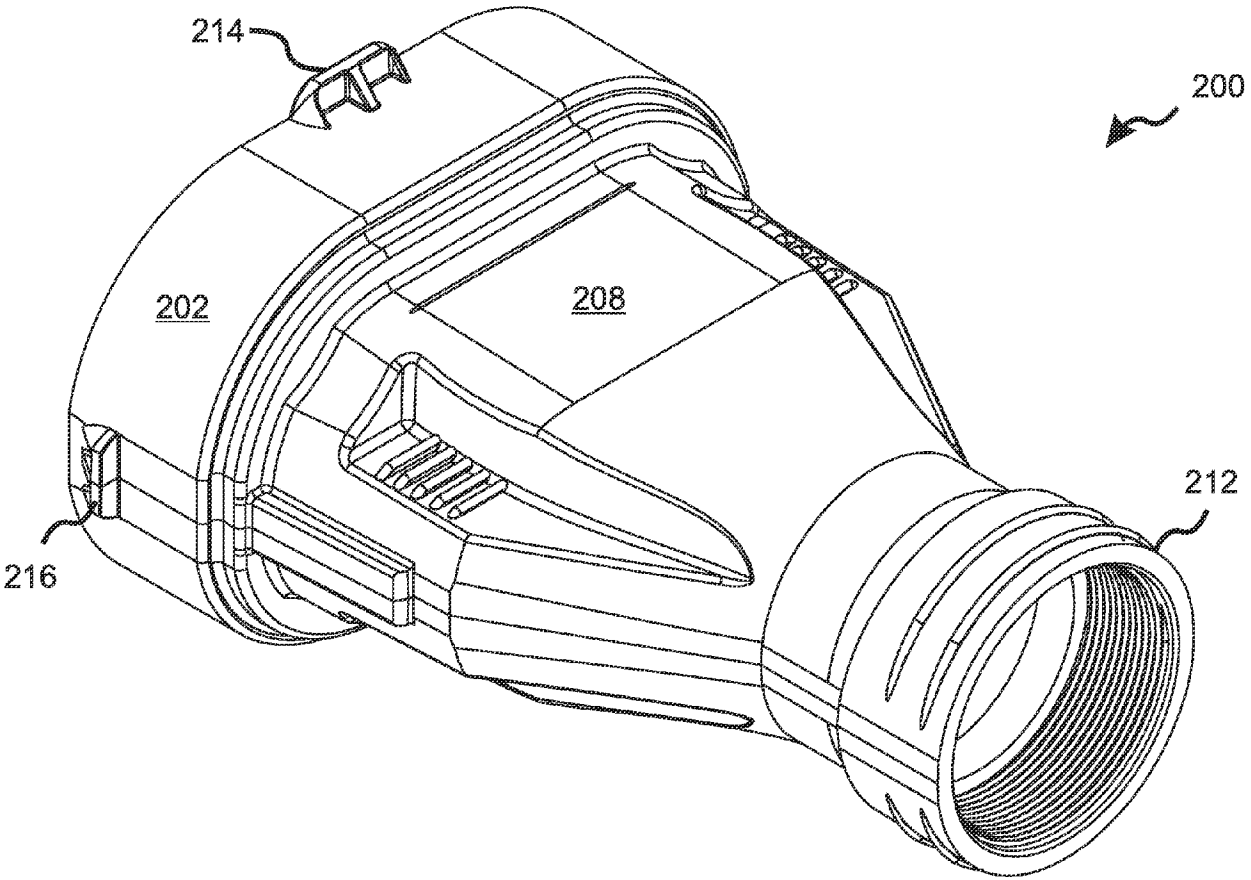
FIG. 2B is a reverse perspective view of the plug housing of FIG. 2A.

The plug housing 200 further includes a cable sheath 208 and a fitting 212 configured for mounting of the plug housing 200 to a threaded conduit such as a threaded pipe or hose. In similar embodiments, the plug housing is configured for direct mounting to a cable, or for mounting to a panel or other flat surface. An orientation key tab 214 is provided so as to prevent inverted mating of the plug housing 200 with the receptacle housing 100 by requiring that the orientation key 214 be aligned with the orientation key slot 114 of the receptacle housing 100 before the plug housing 200 can be mated with the receptacle housing 100. A pair of latch tabs 216 are included on opposing sides of the plug housing 200, whereby when the plug housing 200 is mated with the receptacle housing 100 the latch tabs 216 are inserted into the latch indentations 116 of the receptacle housing 100 and are trapped therein by the latch sliders 118 when the latch sliders 118 are moved to their latched positions. FIG. 2B is a reverse perspective view of the plug housing 200 of FIG. 2A.

Figure 2C:
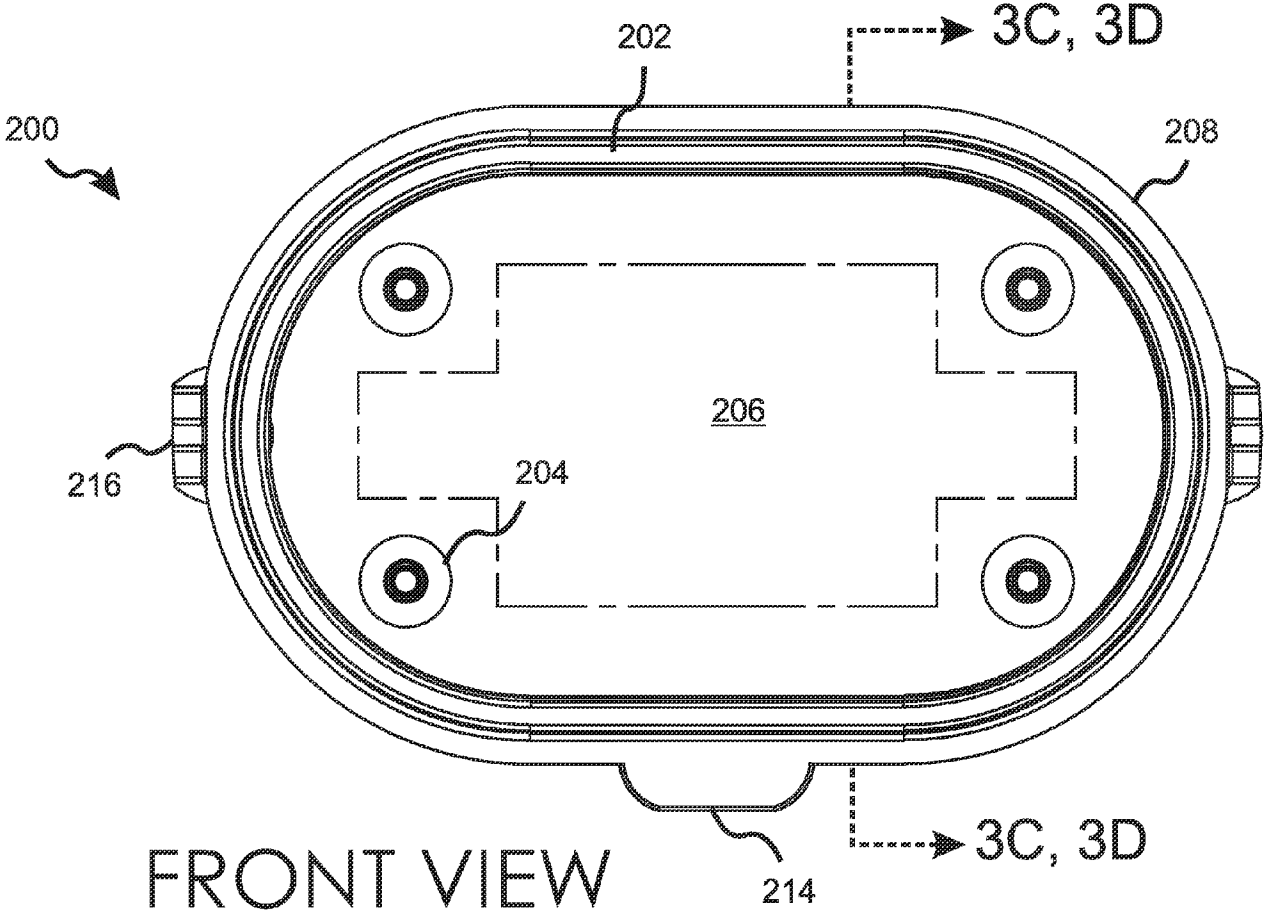
FIGS. 2C through 2H are front, top, right, left, back, and bottom views respectively of the plug housing of FIG. 2A.

FIG. 2C is a front view of the plug housing of FIG. 2A. A cross-sectional location is indicated in the figure corresponding to the cross-sectional illustrations included in FIGS. 3C and 3D. FIGS. 2D through 2H are top, right, left, back, and bottom views, respectively, of the plug housing of FIG. 2A.

Figure 3A:
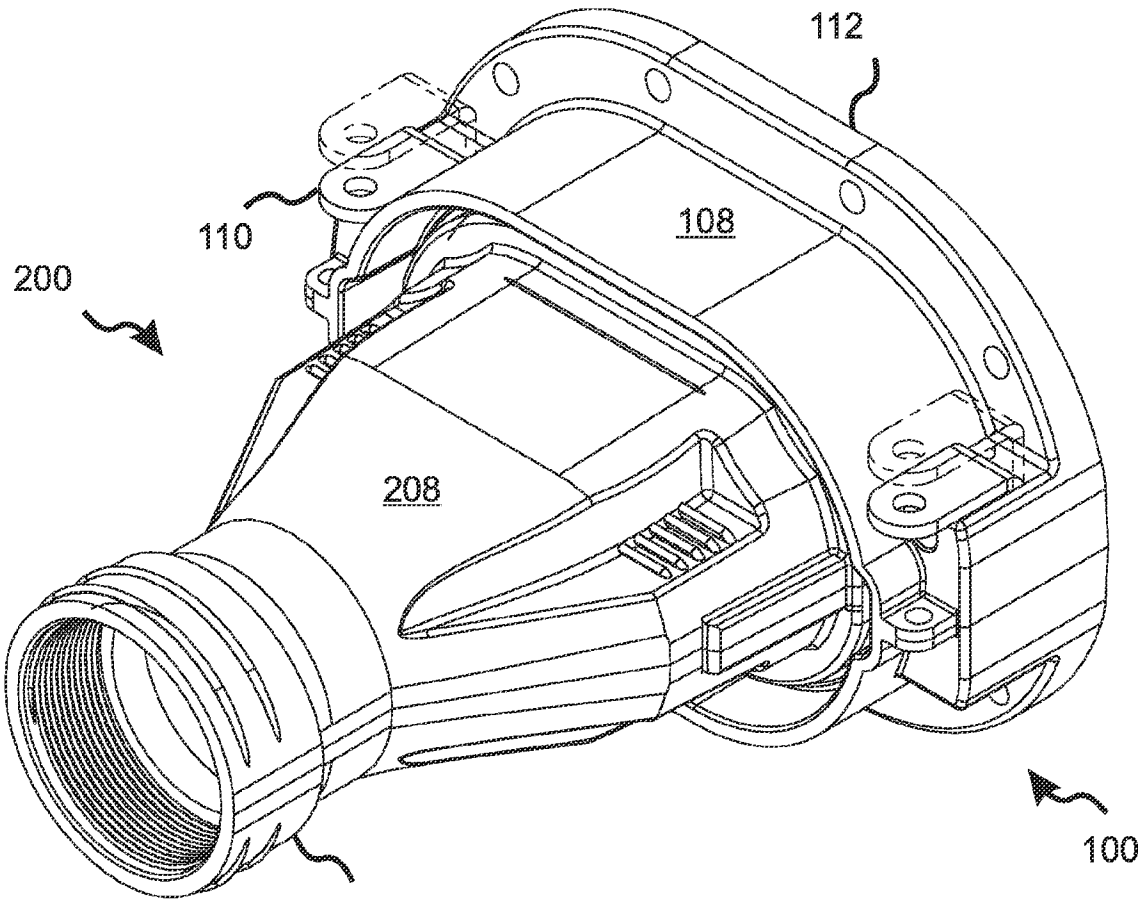
FIG. 3A is a perspective view showing the receptacle housing of FIG. 1A mated with the plug housing of FIG. 2A.
Figure 3B:
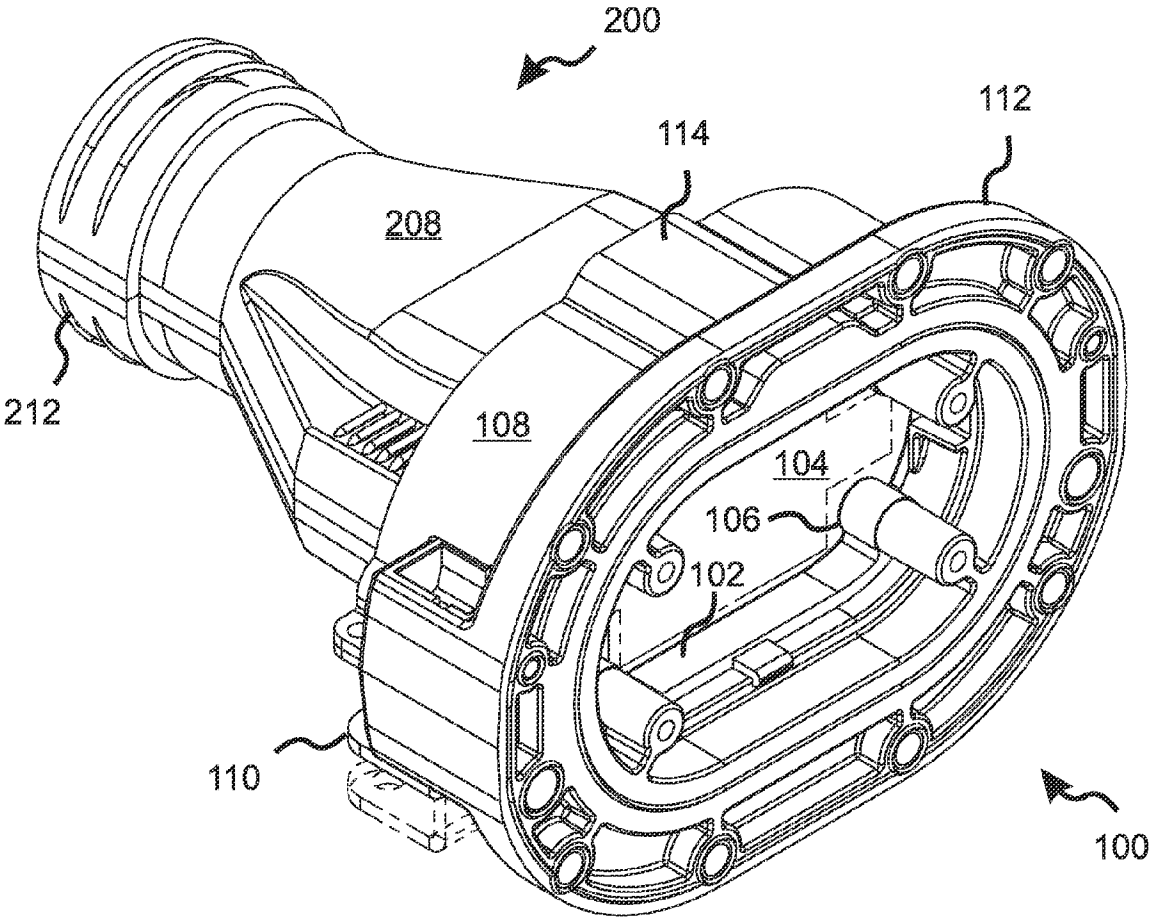
FIG. 3B is a reverse perspective view of the mated plug and receptacle housings of FIG. 3A.

FIG. 3A is a perspective view of the complete connector housing system embodiment of FIG. 1A and FIG. 2A, showing the plug housing 200 mated with the receptacle housing 100. The slider tabs 110 are shown in their latched positions in solid lines, and in their unlatched positions in dashed lines. A reverse perspective view of the mated plug housing 200 and receptacle housing 100 is presented in FIG. 3B.

Figure 2D:
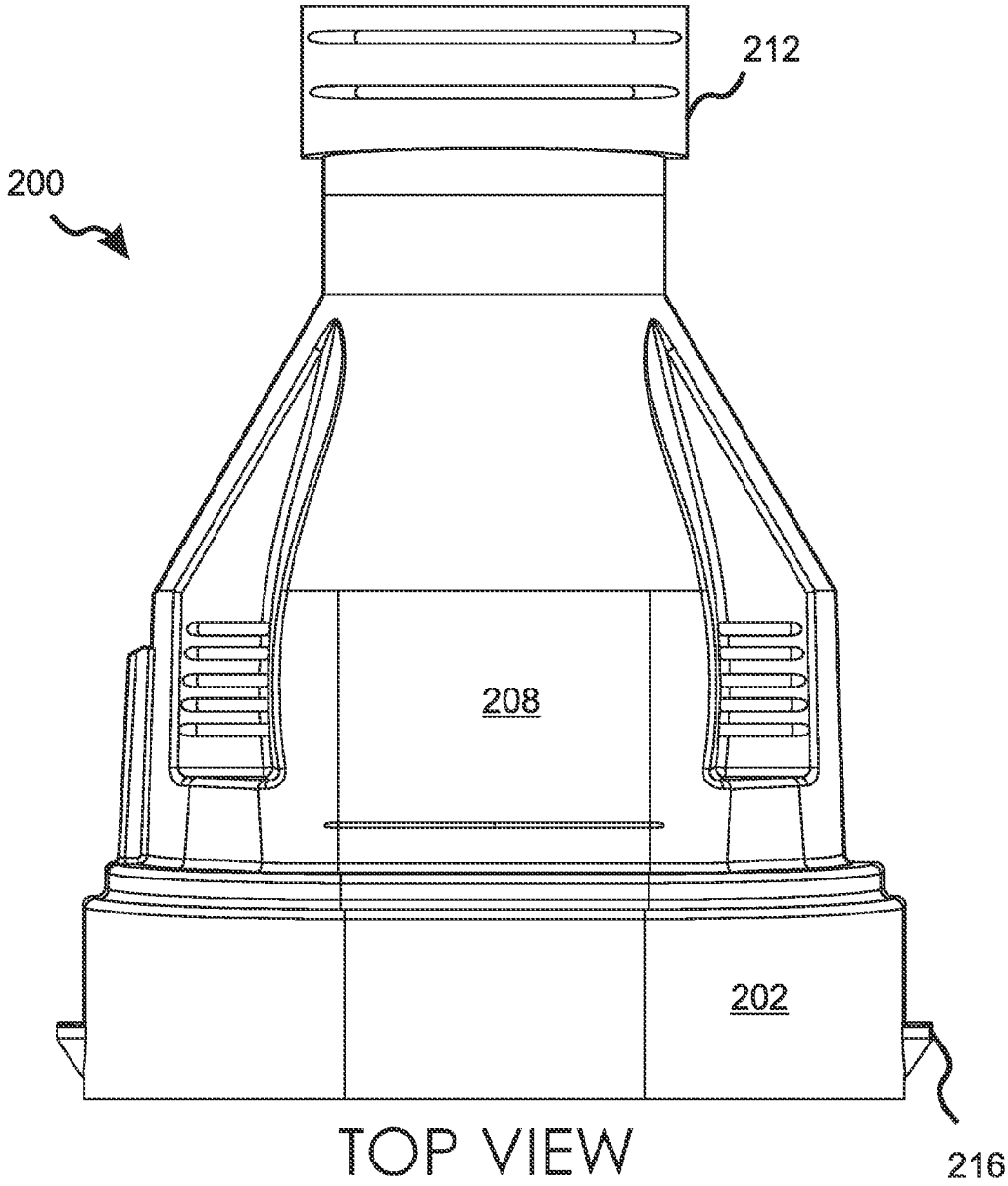
Figure 2E:
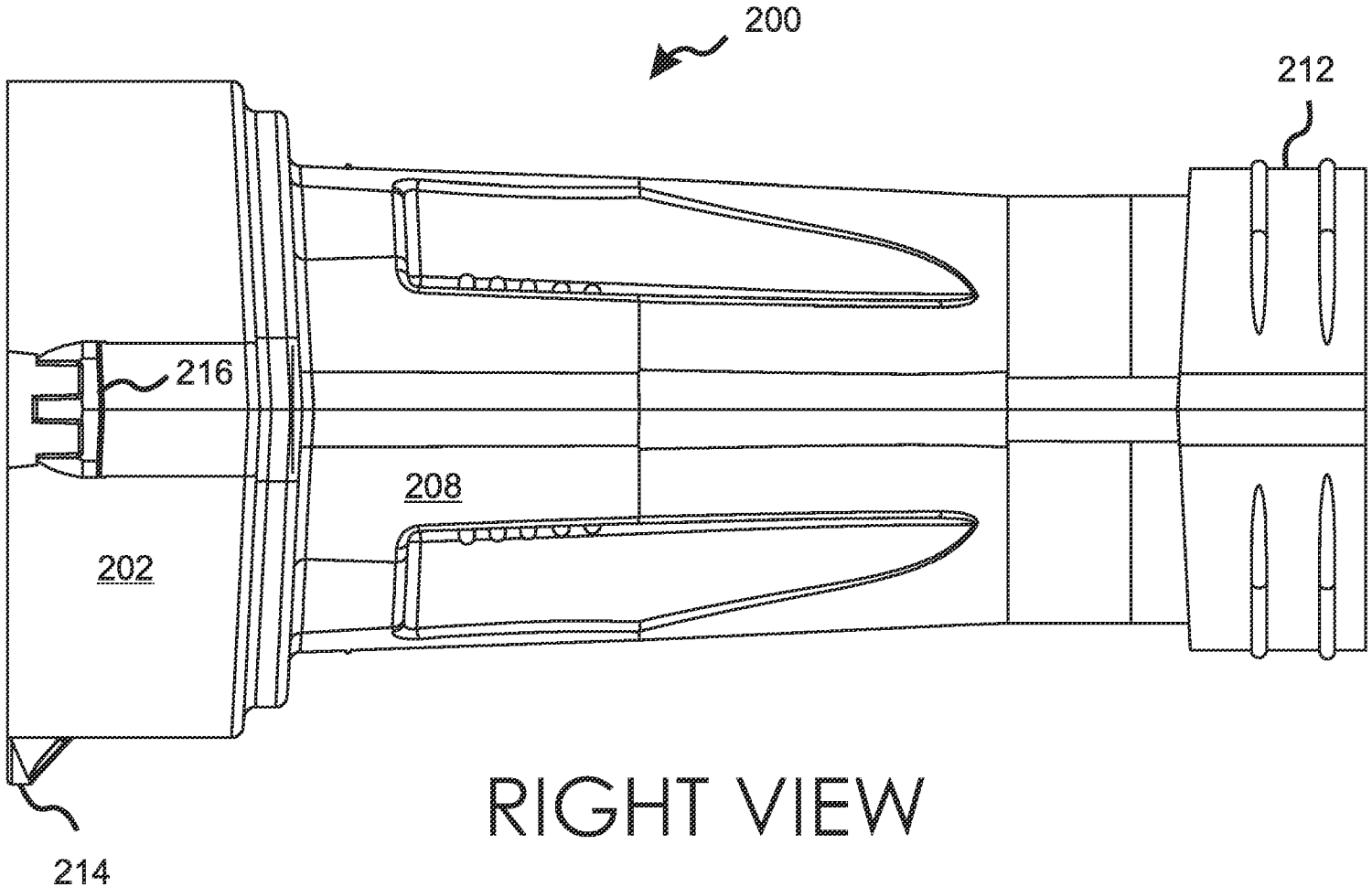
Figure 2F:
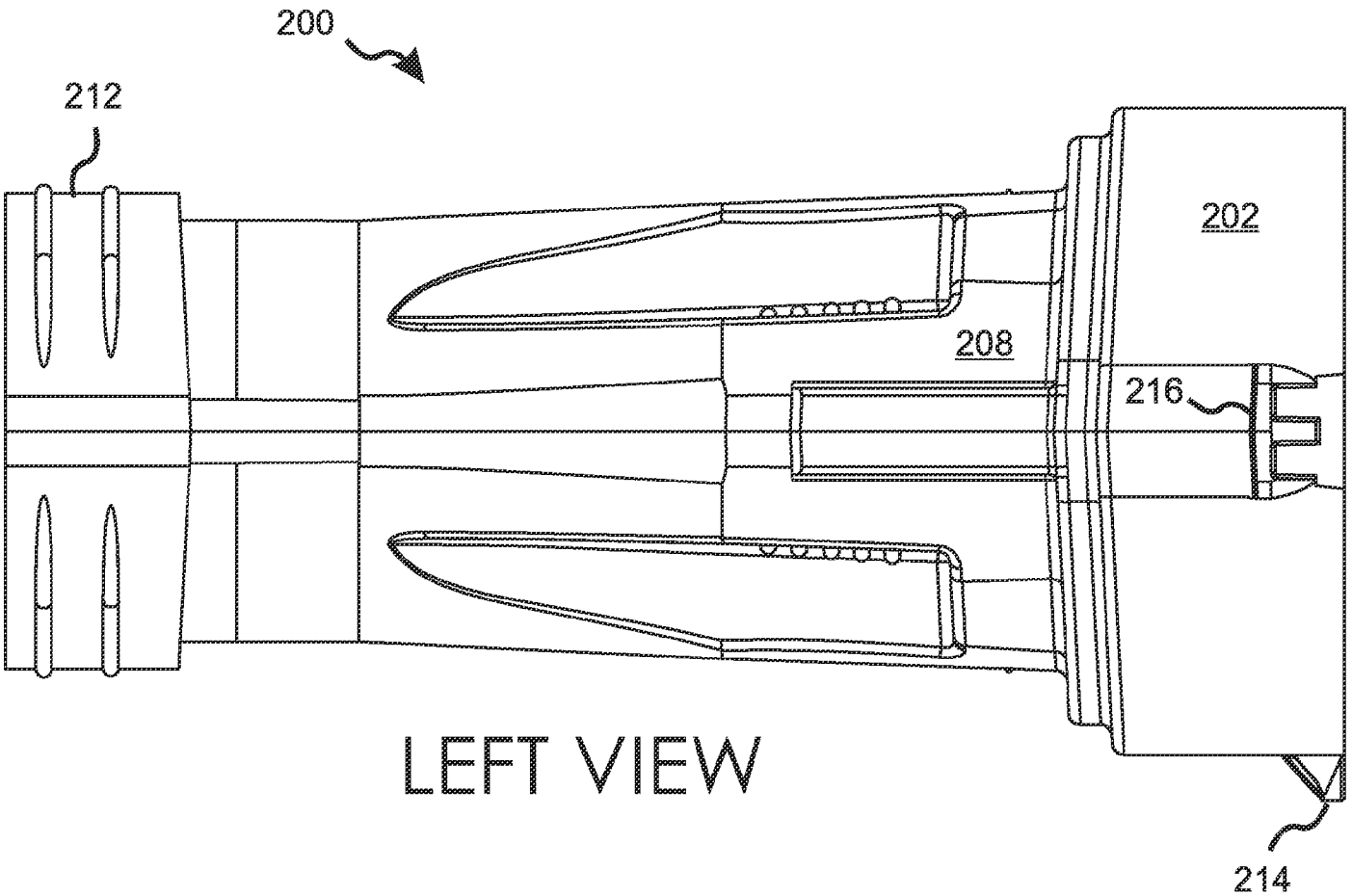
Figure 2G:
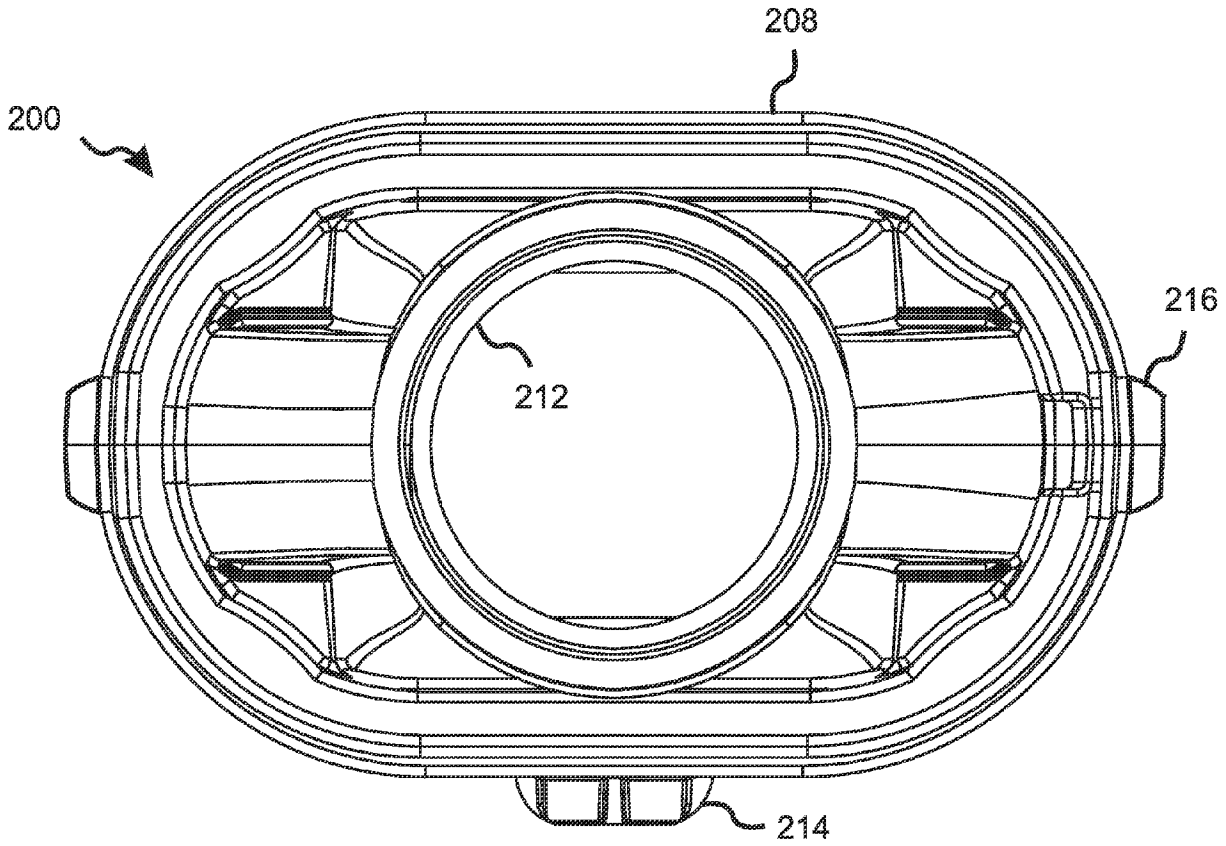
Figure 2H:
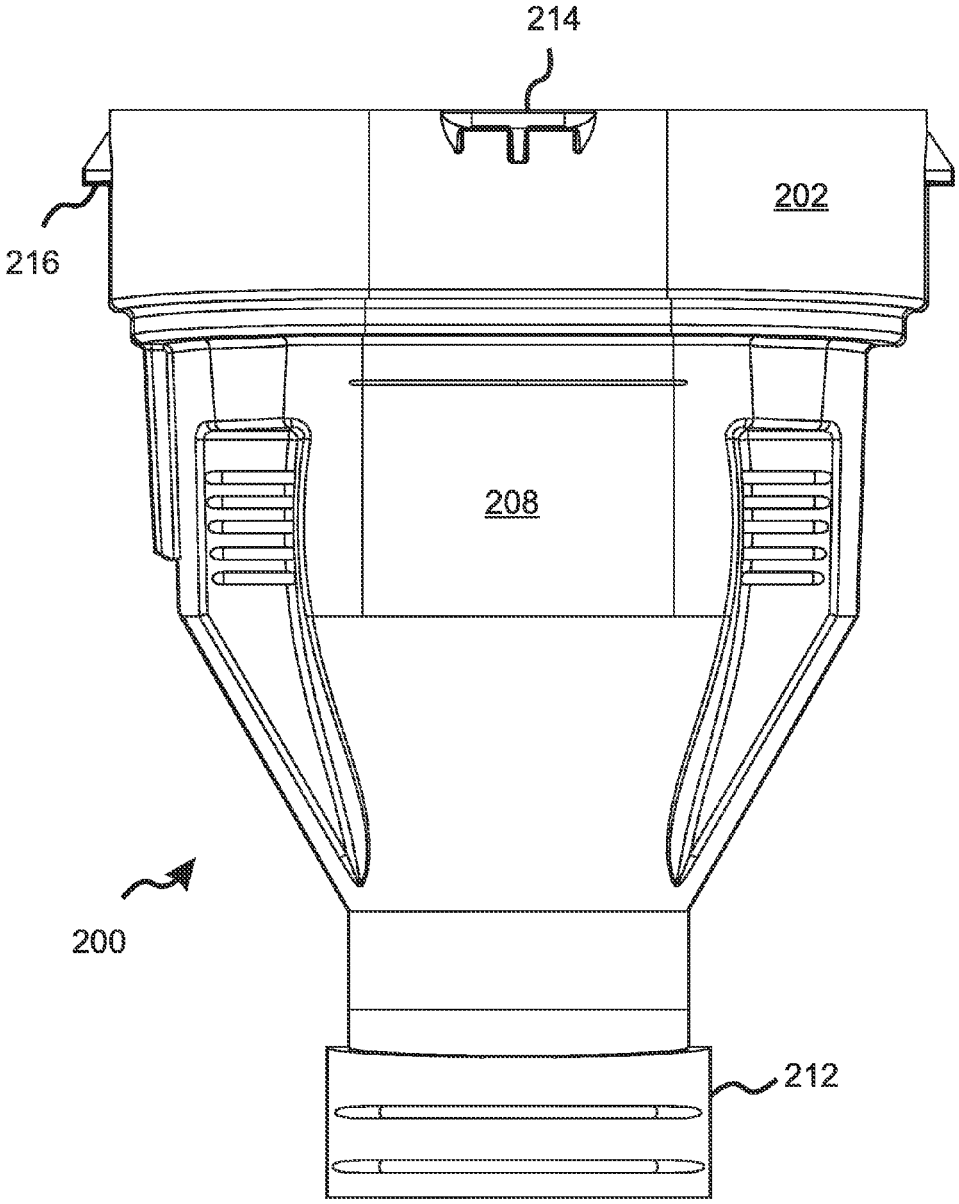
Figure 3C:
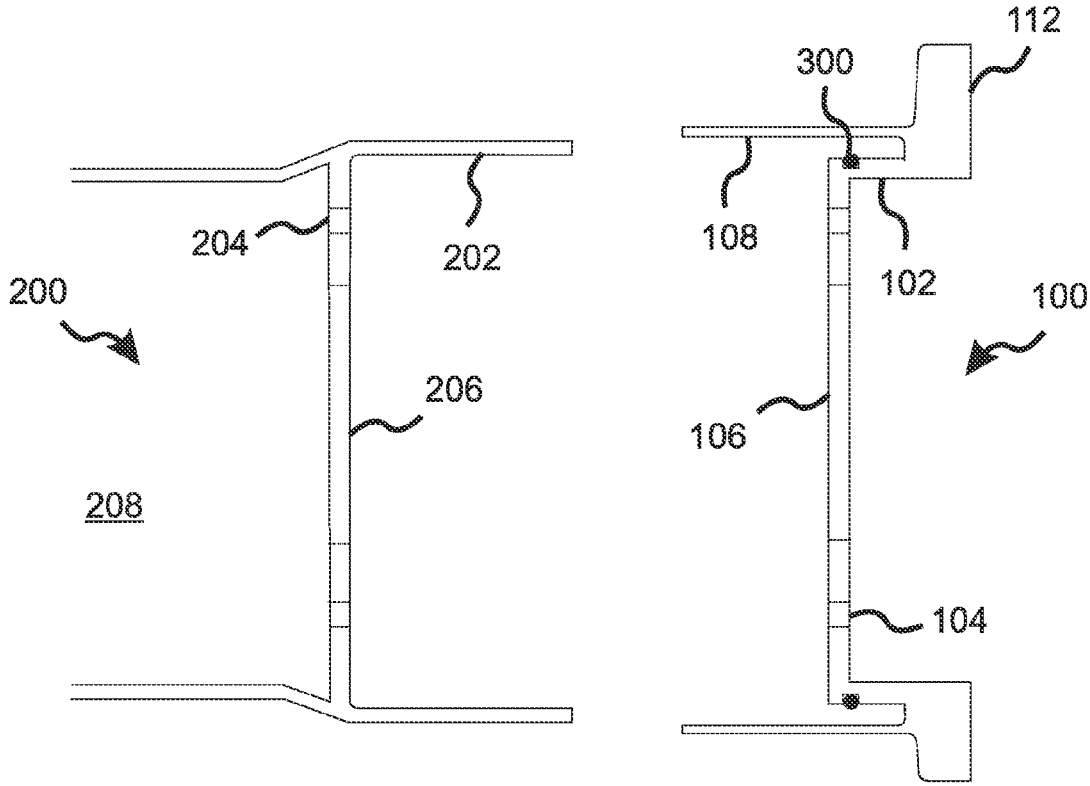
FIG. 3C is a cross-sectional view of the receptacle housing of FIG. 1A and the plug housing of FIG. 2A, shown in a separated relationship.
Figure 3D:
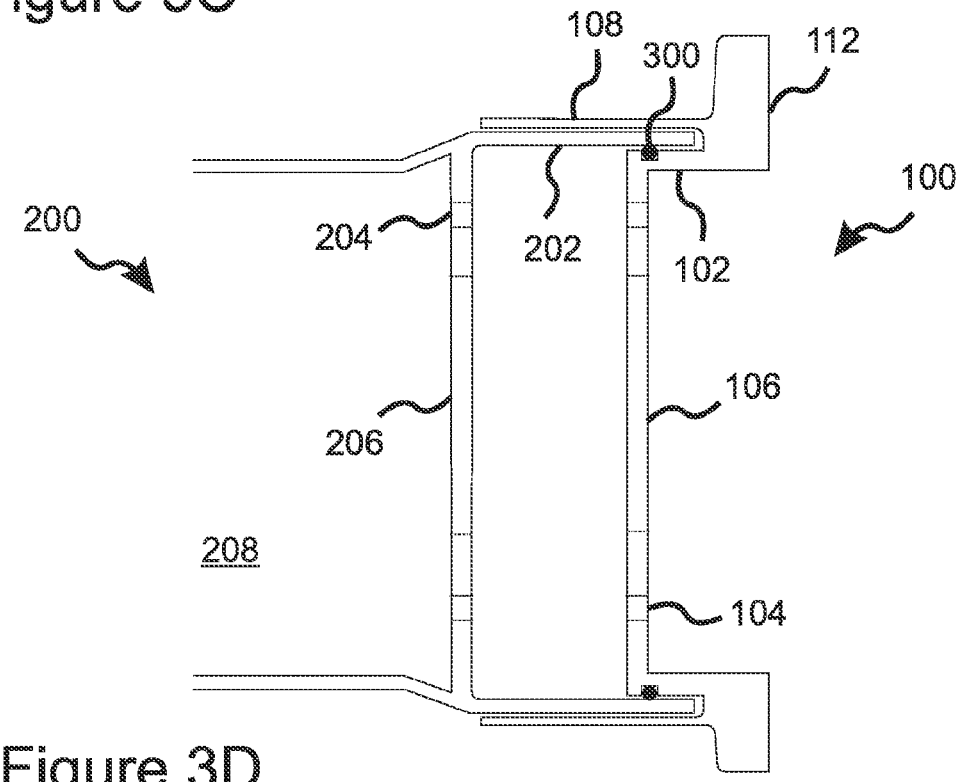
FIG. 3D is a cross-sectional view of the receptacle housing of FIG. 1A and the plug housing of FIG. 2A, shown in a mated relationship.

FIG. 3C is a cross-sectional illustration of the plug housing 200 and receptacle housing 100 of FIG. 3A, shown in a separated relationship. The locations of the cross sections are indicated in FIG. 1D and FIG. 2D. The o-ring groove and installed o-ring 300 can be seen in the curved wall 102 of the receptacle housing 100. FIG. 3D illustrates the cross sections of FIG. 3C in a mated relationship. It can be seen in the figure that the overlapping shell 202 of the plug housing 200 overlaps and surrounds the curved wall 102 of the receptacle housing 100, and in doing so compresses the o-ring 300 between the curved wall 102 and the overlapping shell 202. The direction in which the o-ring is compressed (vertical in FIG. 3D) is perpendicular to the mating direction of the two housings (horizontal in FIG. 3D). Accordingly, the compressive force is applied to the overlapping shell 202 and the curved wall 102, and is not applied to the latch sliders 118. Movement of the latch sliders 118 between their latched and unlatched positions is therefore not hindered by the compressive force applied to the o-ring 300.

Figure 4A:
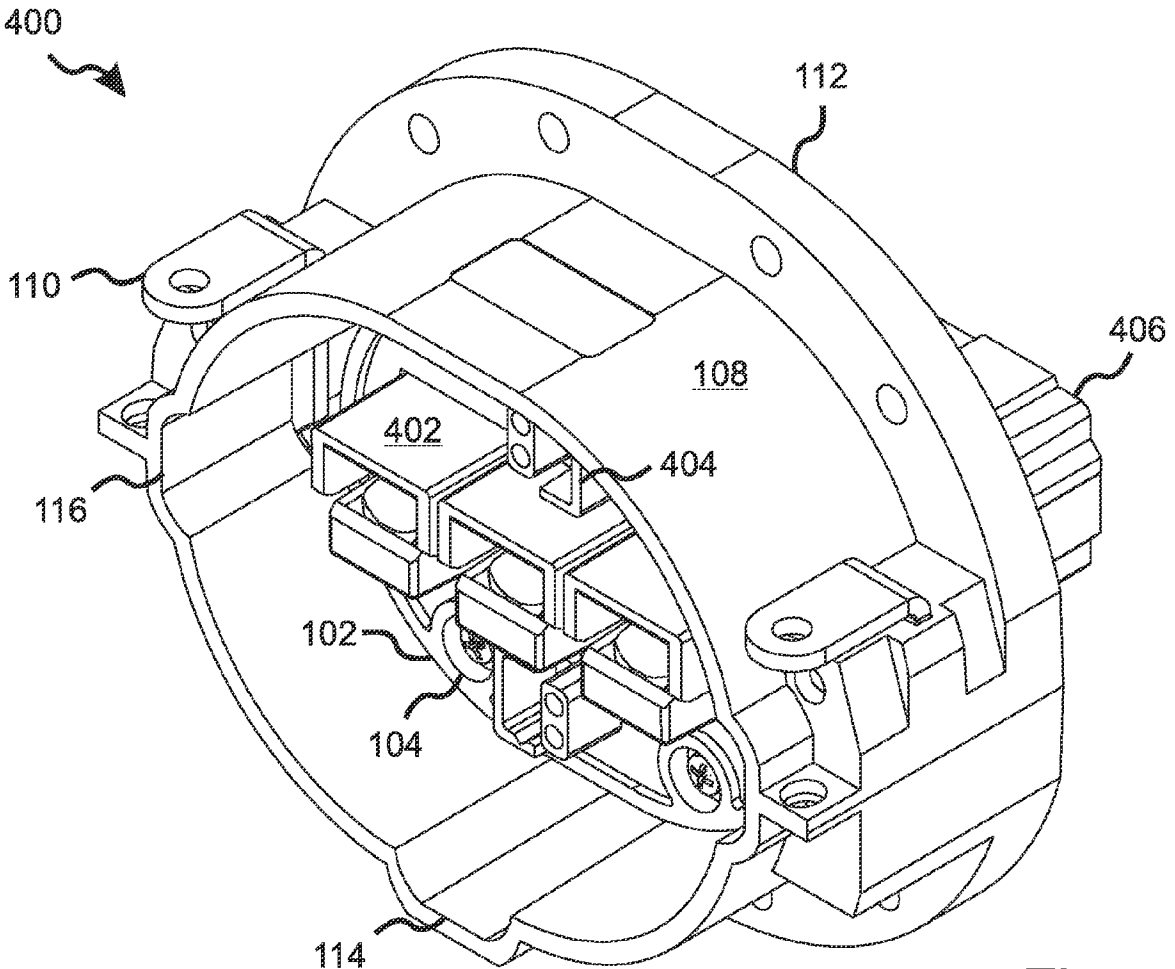
FIG. 4A is a front perspective view of a receptacle housing similar to the receptacle housing of FIG. 1A, in which three insertable high current electrical contacts and two insertable low power electrical contacts have been installed.
Figure 4B:
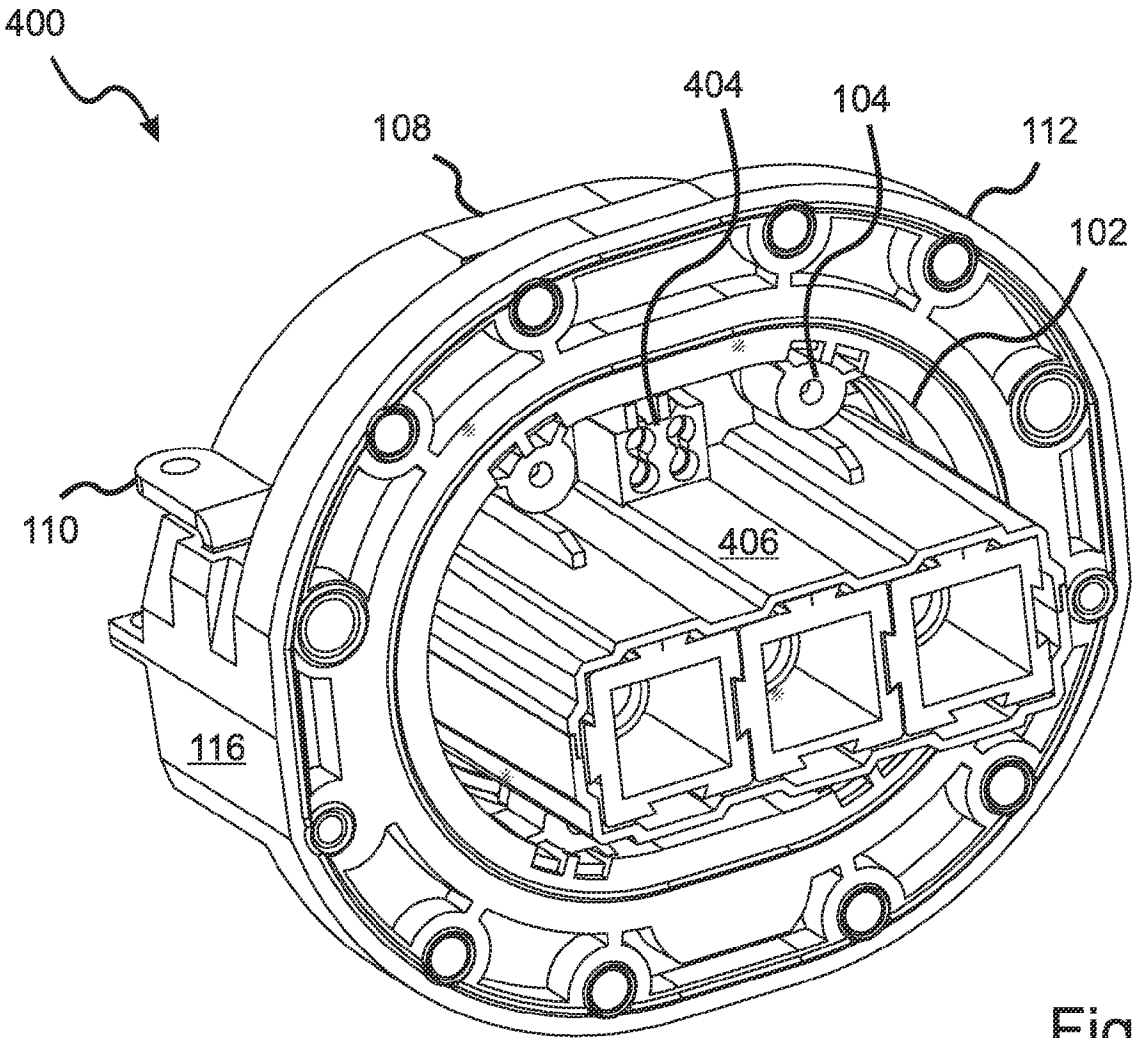
FIG. 4B is a rear perspective view of the receptacle housing of FIG. 4A.

FIG. 4A is a front perspective view of a receptacle housing 400 similar to the housing 100 of FIG. 1A, in which three insertable high current contacts 402 and eight permanently integrated low current contacts 404 have been installed. The cable ends 406 of the high current contacts 404 are visible on the right side of the drawing. FIG. 4B is a rear perspective view of the receptacle housing 400 of FIG. 4A. It can be seen in the figure that the insertable high current contacts 406 interlock with one another when installed in the receptacle housing 400.

Figure 4C:
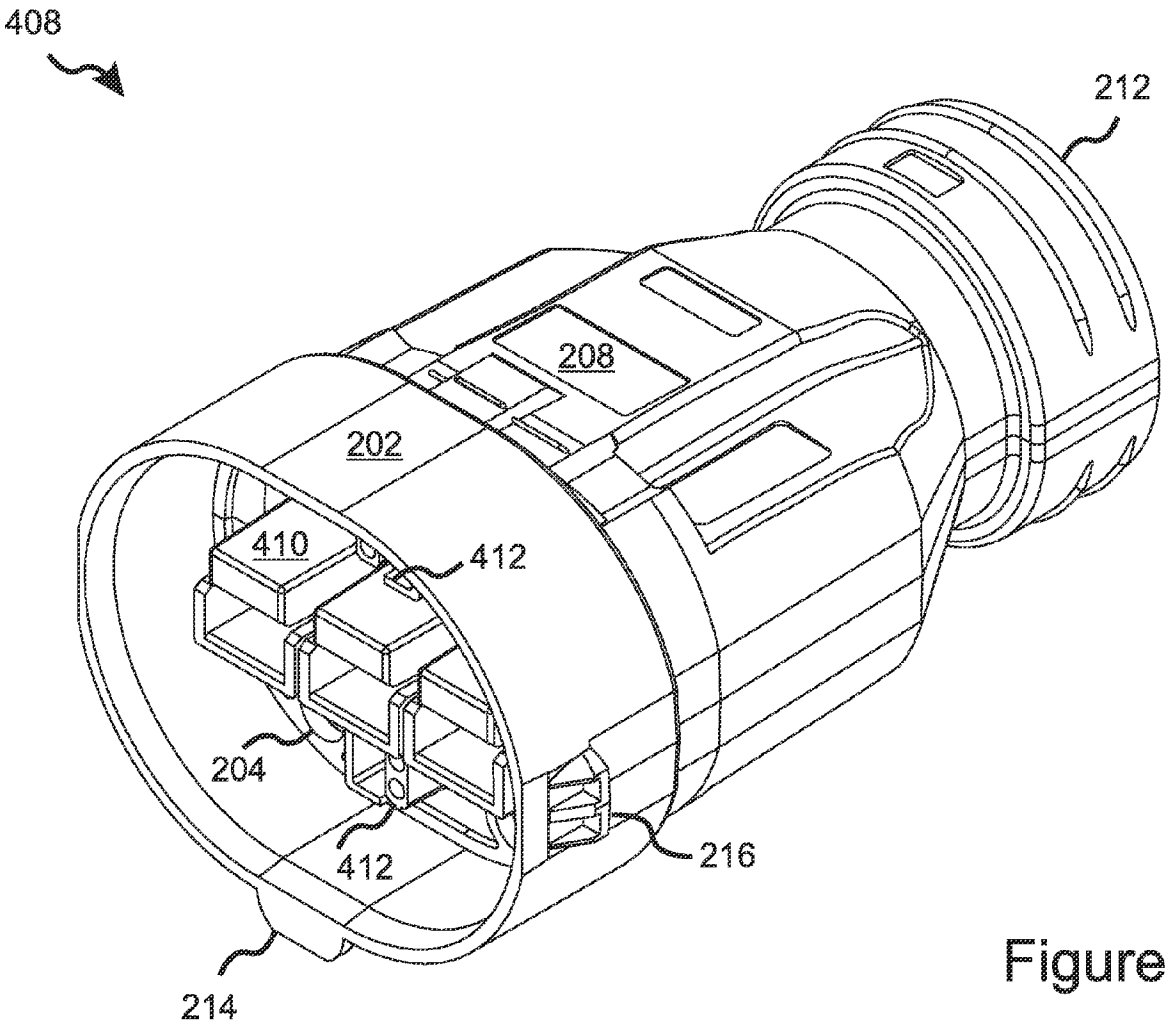
FIG. 4C is a front perspective view of a plug housing similar to the plug housing of FIG. 2A, in which three insertable high current electrical contacts and two insertable low power electrical contacts have been installed, the electrical contacts being compatible with the contacts of FIG. 1A.

FIG. 4C is a front perspective view of a plug housing 408 which is similar to the plug housing of FIG. 2A, and which is compatible with the receptacle housing of FIG. 4A. Three insertable high current contacts 410 and eight permanently integrated low current contacts 412 have been installed in the plug housing 408, and are compatible with the electrical contacts 402, 404 installed in the receptacle housing 400.

Figure 5A:
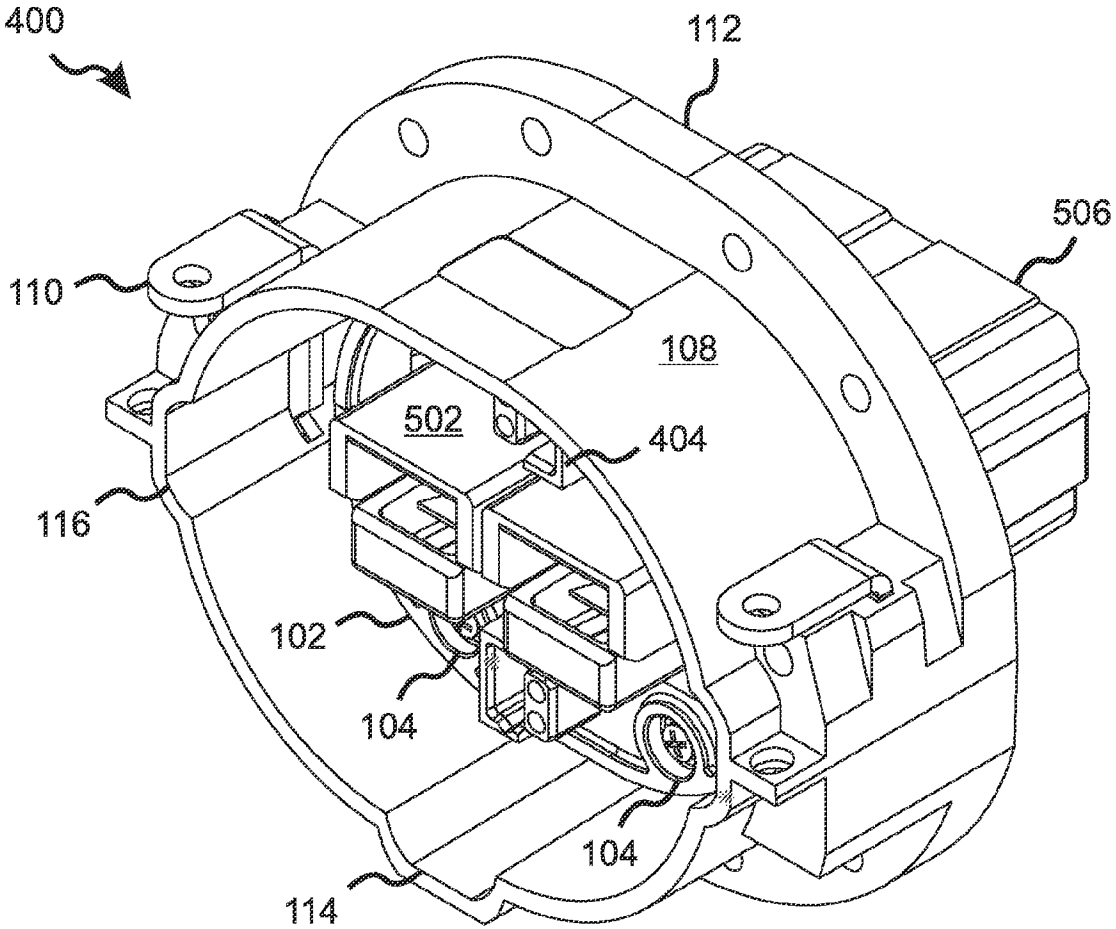
FIG. 5A is a front perspective view of a receptacle housing similar to the receptacle housing of FIG. 1A, in which two insertable high current electrical contacts and two insertable low power electrical contacts have been installed.
Figure 5B:
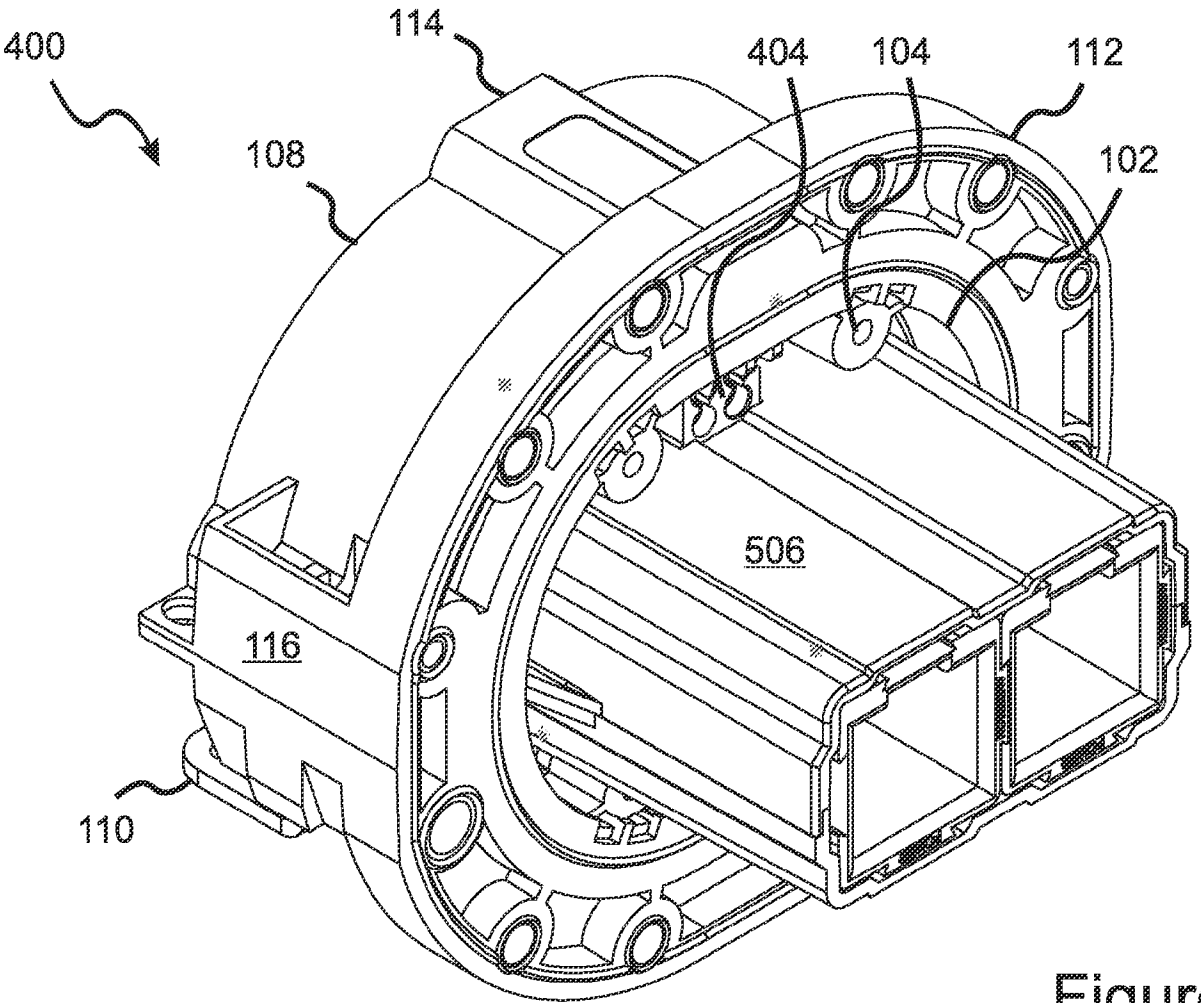
FIG. 5B is a rear perspective view of the receptacle housing of FIG. 4A.

FIG. 5A is a front perspective view of the receptacle housing 400 of FIG. 4A, in which two insertable high current contacts 502 and eight permanently integrated low current contacts 404 have been installed. The cable ends 506 of the high current contacts 502 are visible on the right side of the drawing. FIG. 5B is a rear perspective view of the receptacle housing 400 of FIG. 5A. It can be seen in the figure that the insertable high current contacts 506 interlock with one another when installed in the receptacle housing 400.

Figure 5C:
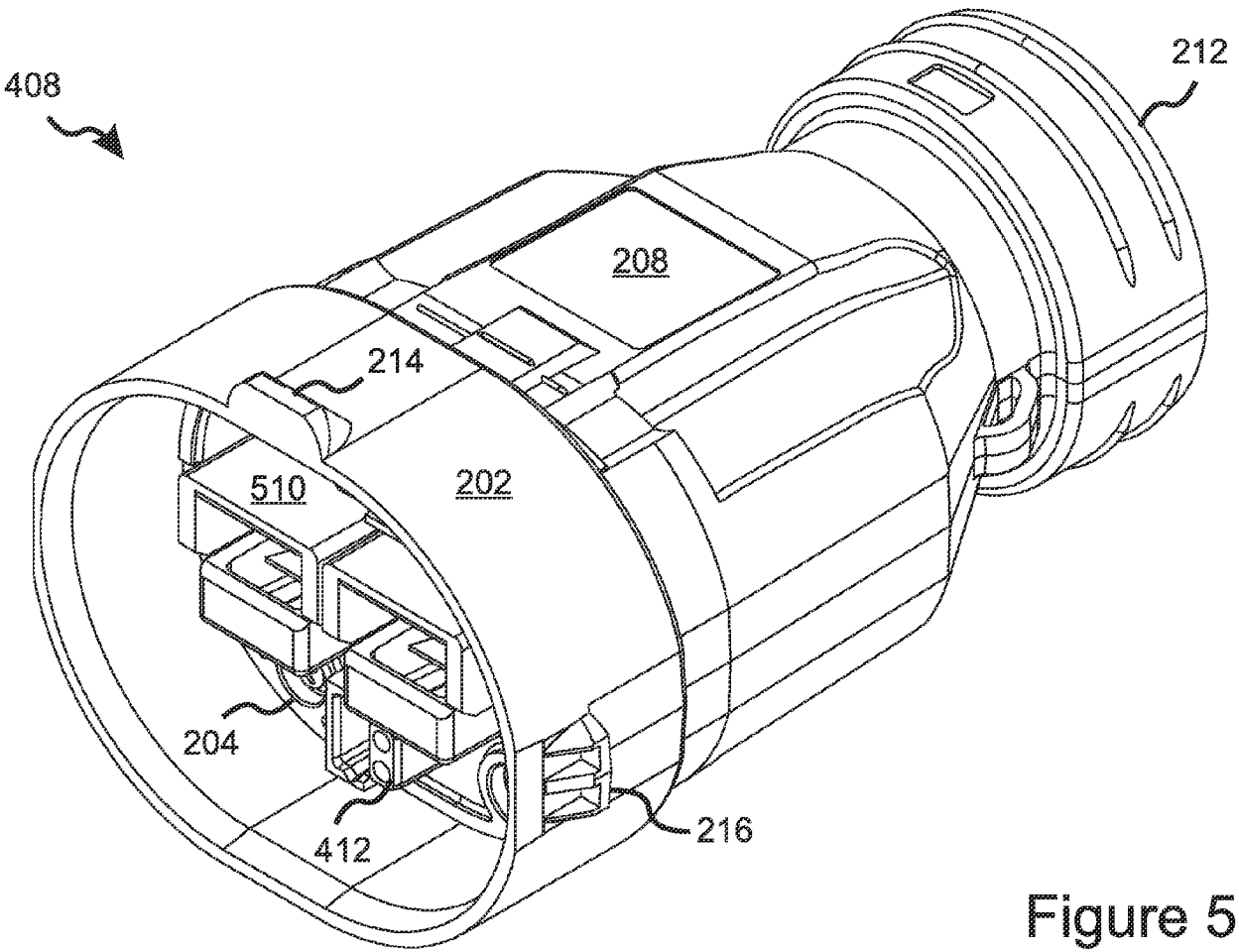
FIG. 5C is a front perspective view of a plug housing similar to the plug housing of FIG. 2A, in which two insertable high current electrical contacts and two insertable low power electrical contacts have been installed, the electrical contacts being compatible with the contacts of FIG. 1A.

FIG. 5C is a front perspective view of the plug housing 408 of FIG. 4C. Two insertable high current contacts 510 and eight permanently integrated low current contacts 412 have been installed in the plug housing 408, and are compatible with the electrical contacts 502, 404 installed in the receptacle housing 400.

Figure 6A:
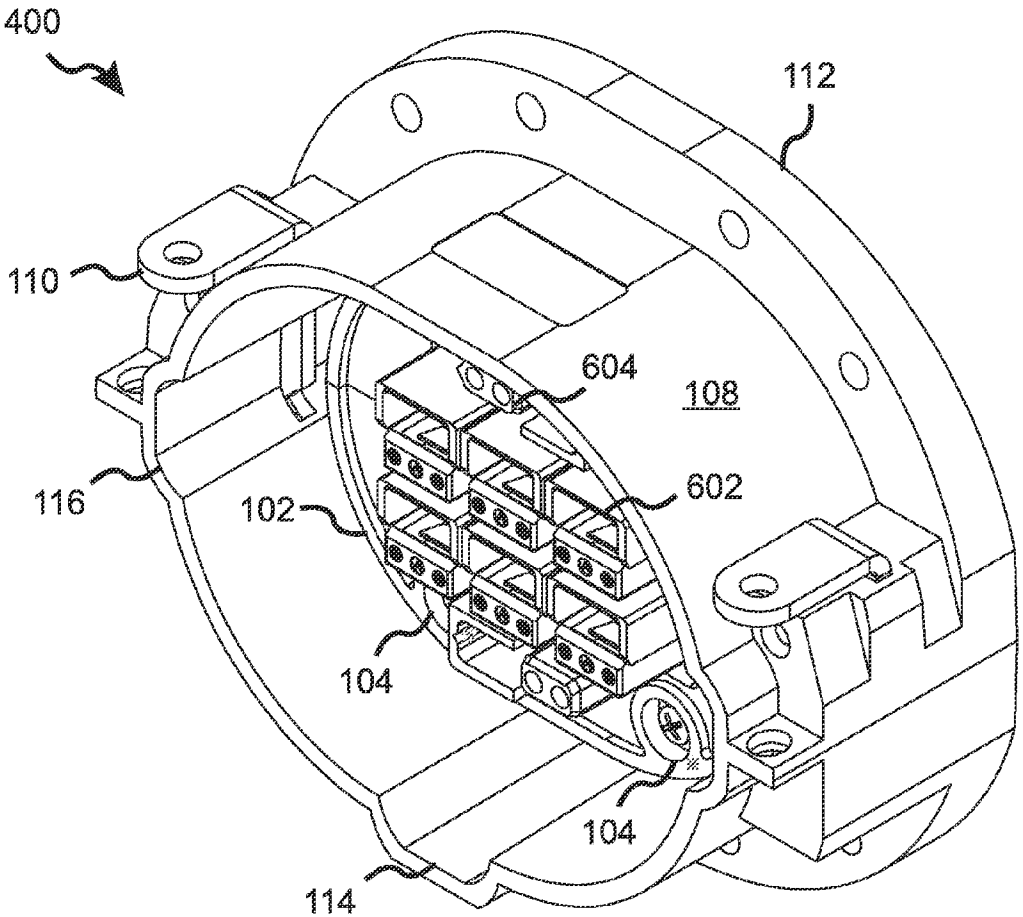
FIG. 6A is a front perspective view of a receptacle housing similar to the receptacle housing of FIG. 1A, in which six insertable high current electrical contacts and two insertable low power electrical contacts have been installed.
Figure 6B:
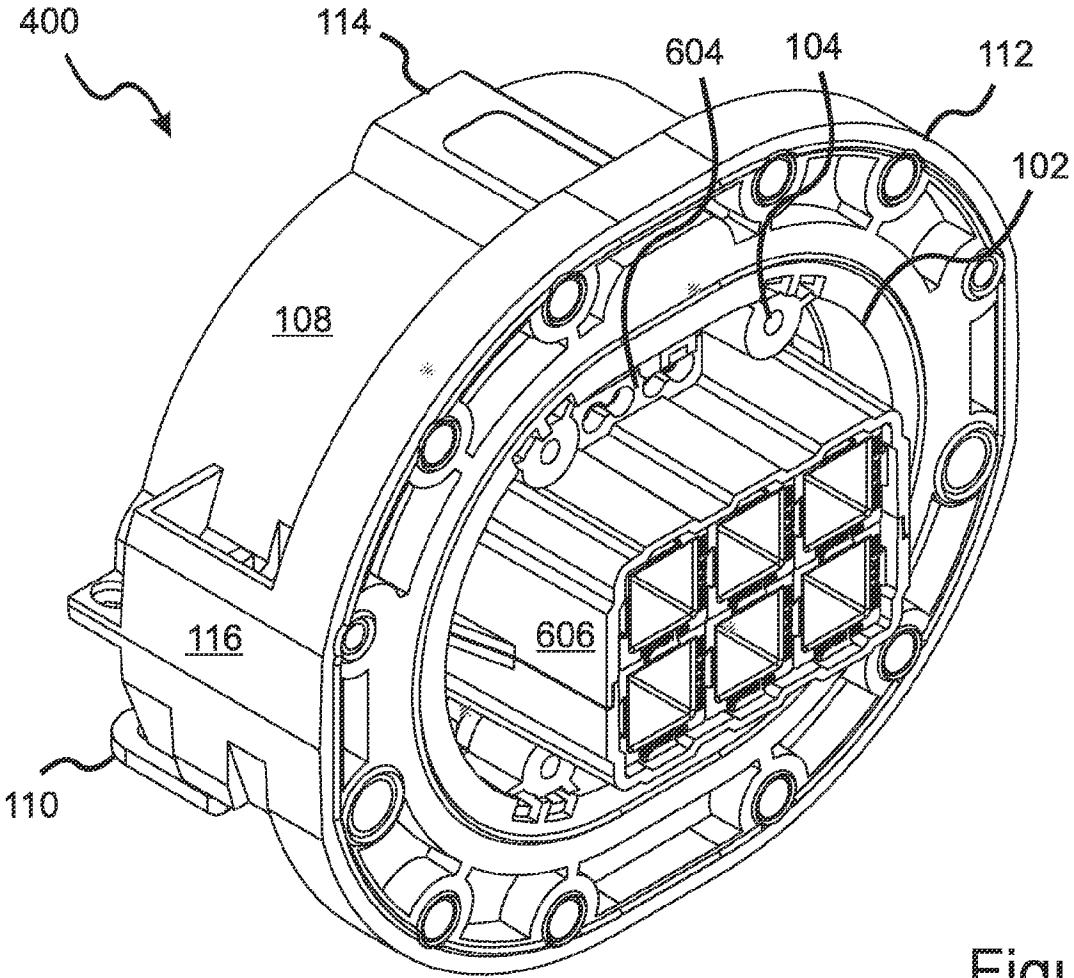
FIG. 6B is a rear perspective view of the receptacle housing of FIG. 4A.

FIG. 6A is a front perspective view of the receptacle housing 400 of FIG. 4A, in which six insertable high current contacts 602 and eight permanently integrated low current contacts 604 have been installed. FIG. 6B is a rear perspective view of the receptacle housing 400 of FIG. 6A. It can be seen in the figure that the insertable high current contacts 606 interlock with one another when installed in the receptacle housing 400. The cable ends 606 of the high current contacts 604 are visible in the figure.

Figure 6C:
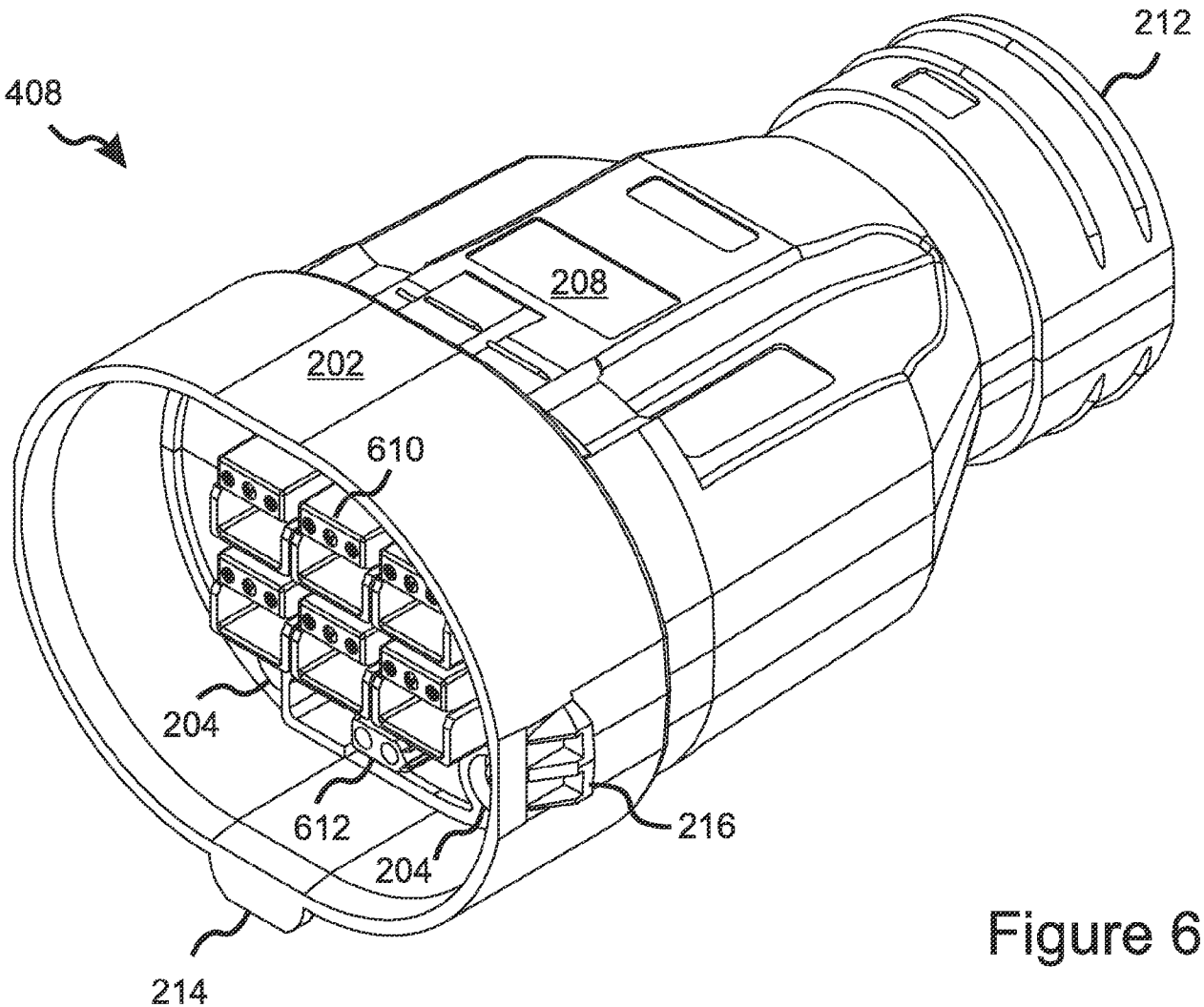
FIG. 6C is a front perspective view of a plug housing similar to the plug housing of FIG. 2A, in which six insertable high current electrical contacts and two insertable low power electrical contacts have been installed, the electrical contacts being compatible with the contacts of FIG. 1A.

FIG. 6C is a front perspective view of the plug housing 408 of FIG. 4C. Six insertable high current contacts 610 and eight permanently integrated low current contacts 612 have been installed in the plug housing 408, and are compatible with the electrical contacts 602, 604 installed in the receptacle housing 400.

The foregoing description of the embodiments of the invention has been presented for the purposes of illustration and description. Each and every page of this submission, and all contents thereon, however characterized, identified, or numbered, is considered a substantive part of this application for all purposes, irrespective of form or placement within the application. This specification is not intended to be exhaustive or to limit the invention to the precise form disclosed. Many modifications and variations are possible in light of this disclosure.

The invention claimed is:

1. A water-tight connector housing system, comprising:

a receptacle housing configured for housing at least one receptacle electrical contact;

a plug housing configured for housing at least one plug electrical contact, the plug housing being configured for mating with the receptacle housing in a mating direction so as to create an electrical connection between the receptacle electrical contact and the plug electrical contact;

a latch mechanism which can be transitioned between an unlatched configuration and a latched configuration, the latch mechanism in the latched configuration being able to inhibit separation of the plug housing from the receptacle housing when the plug housing is mated to the receptacle housing, the latch mechanism including a plurality of latch tabs extending outward from the overlapping shell of the plug housing, a plurality of latch slots formed in the outer shell of the receptacle housing and configured to accept insertion therein of the latch tabs when the plug housing is mated with the receptacle housing, and a plurality of latch sliders mounted in the receptacle housing and slidable between latched positions and unlatched positions, the latch sliders being configured so as to pass behind the latch tabs and thereby trap the latch tabs within the latch slots when the plug housing is mated with the receptacle housing and the latch sliders are moved to the latched positions;

a receptacle contact support structure contained within the receptacle housing and configured for supporting the at least one receptacle electrical contact, the receptacle contact support structure being substantially planar and oriented perpendicular to the mating direction, the receptacle contact support structure being supported by a curved wall surrounding a perimeter of the receptacle contact support structure and extending rearward from the receptacle contact support structure;

an o-ring groove formed in an outward-facing surface of the curved wall, the o-ring groove lying in a plane that is perpendicular to the mating direction;

a plug contact support structure contained within the plug housing and configured for supporting the at least one plug electrical contact, the plug contact support structure being substantially planar and oriented perpendicular to the mating direction; and an overlapping shell surrounding a perimeter of the plug contact support structure and extending forward from the plug contact support structure in the mating direction, the overlapping shell being configured so as to overlap and surround the curved wall and compress an o-ring located in the o-ring groove when the plug housing is mated with the receptacle housing, the o-ring being thereby compressed in a direction perpendicular to the mating direction so as to apply substantially no reactive force to the latch mechanism in the latched configuration.

2. The water-tight connector housing system of claim 1, further comprising a detent mechanism configured so as to inhibit transitioning of the latch mechanism from the latched configuration to the unlatched configuration.

3. The water-tight connector housing system of claim 1, wherein the latch mechanism can be manually transitioned from the latched configuration to the unlatched configuration without use of a tool.

4. The water-tight connector housing of claim 1, wherein use of a tool is required so as to transition the latch mechanism from the latched configuration to the unlatched configuration.

5. The water-tight connector housing system of claim 1, wherein each of the receptacle contact support structure and the plug contact support structure includes at least one permanently mounted electrical contact.

6. The water-tight connector housing system of claim 1, wherein each of the receptacle contact support structure and the plug contact support structure is configured to accept at least one insertable electrical contact.

7. The water-tight connector housing system of claim 1, wherein the receptacle housing further includes an outer shell configured to surround and guide the overlapping shell of the plug housing when the plug housing is mated with the receptacle housing.

8. The water-tight connector housing system of claim 7, wherein the plug housing further includes an orientation key tab extending outward from the overlapping shell, and the receptacle housing includes an orientation key slot extending outward from the outer shell, the orientation key slot being cooperative with the orientation key tab so as to inhibit mating of the plug housing with the receptacle housing if the plug housing is not correctly oriented relative to the receptacle housing.

9. The water-tight connector housing system of claim 1, further comprising a detent mechanism configured so as to inhibit transitioning of the latch mechanism to the unlatched configuration when the latch mechanism is in the latched configuration, the detent mechanism including:

a detent hole in each of the pair of latch sliders; and a pair of detent sliders pressed by a pair of springs against the pair of latch sliders, the springs being configured so as to seat ends of the detent sliders in the detent holes when the latch sliders are in the latched positions.

10. The water-tight connector housing system of claim 1, wherein at least one of the receptacle housing and the plug housing is configured for direct attachment to an electrical cable.

11. The water-tight connector housing system of claim 1, wherein at least one of the receptacle housing and the plug housing is configured for mounting to a flat surface.

12. The water-tight connector housing system of claim 1, wherein at least one of the receptacle housing and the plug housing is configured for mounting to a threaded conduit.

13. The water-tight connector housing system of claim 1, further comprising a plurality of insertable receptacle electrical contacts configured for installation in the receptacle contact support structure and an equal number of insertable plug electrical contacts configured for installation in the plug contact support structure, the receptacle electrical contacts being configured for interlocking inter-connection when installed in the receptacle contact support structure, and the plug electrical contacts being configured for interlocking inter-connection when installed in the plug contact support structure.

14. A water-tight connector housing system, comprising:

a receptacle housing configured for housing at least one receptacle electrical contact;

a plug housing configured for housing at least one plug electrical contact, the plug housing being configured for mating with the receptacle housing in a mating direction so as to create an electrical connection between the receptacle electrical contact and the plug electrical contact;

an o-ring groove configured within the receptacle housing so as to cause an o-ring located in the o-ring groove to be compressed in a direction perpendicular to the mating direction when the plug housing is mated with the receptacle housing, so that substantially no compressive force is required to maintain the plug housing in mated relationship with the receptacle housing; and a latch mechanism which can be transitioned between an unlatched configuration and a latched configuration, the latch mechanism including a plurality of latch sliders cooperative with one of the plug housing and the receptacle housing and a corresponding plurality of latch tabs cooperative with the other of the plug housing and the receptacle housing, the latch sliders being able to trap the latch tabs when the latch mechanism is in the latched configuration so as to inhibit separation of the plug housing from the receptacle housing when the plug housing is mated to the receptacle housing, said compression of the o-ring applying substantially no reactive force to the latch mechanism in the latched configuration.

15. The water-tight connector housing system of claim 14, wherein the latch mechanism can be manually transitioned from the latched configuration to the unlatched configuration without use of a tool.

16. The water-tight connector housing of claim 14, wherein use of a tool is required so as to transition the latch mechanism from the latched configuration to the unlatched configuration.

17. The water-tight connector housing system of claim 14, wherein each of the receptacle housing and the plug housing includes at least one permanently mounted electrical contact.

18. The water-tight connector housing system of claim 14, wherein each of the receptacle housing and the plug housing is configured to accept at least one insertable electrical contact.

* * * * *